US007743739B2

(12) United States Patent
Kochi et al.

(10) Patent No.: US 7,743,739 B2
(45) Date of Patent: Jun. 29, 2010

(54) ENGINE-DRIVEN GENERATOR

(75) Inventors: Toshifumi Kochi, Saitama (JP); Tadafumi Hirose, Saitama (JP); Ryuji Tsuru, Saitama (JP); Shouhei Kasagi, Saitama (JP); Yuji Shimada, Saitama (JP); Takeshi Maeda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 518 days.

(21) Appl. No.: 10/561,614

(22) PCT Filed: Jul. 8, 2004

(86) PCT No.: PCT/JP2004/009713

§ 371 (c)(1),
(2), (4) Date: Mar. 5, 2008

(87) PCT Pub. No.: WO2005/005806

PCT Pub. Date: Jan. 20, 2005

(65) Prior Publication Data

US 2008/0202447 A1 Aug. 28, 2008

(30) Foreign Application Priority Data

Jul. 10, 2003 (JP) ..... 2003-273023
Jul. 10, 2003 (JP) ..... 2003-273026
Jul. 10, 2003 (JP) ..... 2003-273029

(51) Int. Cl.
*F02B 63/00* (2006.01)
*F01P 9/04* (2006.01)
*F02M 35/02* (2006.01)

(52) U.S. Cl. ..... 123/2; 123/41.57; 123/198 E; 290/1 A

(58) Field of Classification Search ..... 123/2, 123/41.57, 41.7, 198 E; 181/204; 290/1 A, 290/1 B
See application file for complete search history.

(56) References Cited

U.S. PATENT DOCUMENTS 6,039,009 A * 3/2000 Hirose ..... 123/2

(Continued)

FOREIGN PATENT DOCUMENTS

JP 55-90748 6/1980

(Continued)

*Primary Examiner*—Noah Kamen
(74) *Attorney, Agent, or Firm*—Arent Fox LLP

(57) ABSTRACT

An engine-driven generator is provided that is formed by supporting an engine (3) and a generator (4) on a frame (2), wherein the frame (2) is formed as an open periphery framework type, within this frame (2) a duct member (31) is disposed around the outer periphery of the engine (3) and the generator (4), the duct member (31) defining a series of cooling air passages (32) between itself and the engine (3) and generator (4), a cooling fan (26) is provided in the cooling air passage (32), the cooling fan (26) being driven by the engine (3), an intake box (34) having an intake opening (38) at an outer end thereof and housing an electrical component (53, 55) is connected to the upstream end of the duct member (31), and an exhaust box (68) having an exhaust opening (73) at an outer end thereof and housing an exhaust muffler (74) of the engine (3) is connected to the other end of the duct member (31). A compact engine-driven generator that enables running noise to be reduced can thereby be provided.

19 Claims, 20 Drawing Sheets

U.S. PATENT DOCUMENTS

| | | | | |
|---|---|---|---|---|
| 6,362,533 | B1 * | 3/2002 | Morohoshi et al. | 290/1 A |
| 2003/0070652 | A1 | 4/2003 | Suzuki et al. | |

FOREIGN PATENT DOCUMENTS

| | | | |
|---|---|---|---|
| JP | 58-90318 | U | 6/1983 |
| JP | 61-95939 | U | 6/1986 |
| JP | 1-166234 | U | 11/1989 |
| JP | 1-176721 | U | 12/1989 |
| JP | 11-36880 | A | 2/1999 |
| JP | 11-36881 | A | 2/1999 |
| JP | 11-200951 | A | 7/1999 |
| JP | 3065852 | U | 11/1999 |
| JP | 2000-213361 | A | 8/2000 |
| JP | 2003-097286 | A | 4/2003 |
| JP | 2003-120315 | A | 4/2003 |

* cited by examiner

ENGINE-DRIVEN GENERATOR

CROSS-REFERENCE TO RELATED APPLICATION

This application is a National Stage entry of International Application No. PCT/JP2004/009713, filed Jul. 8, 2004, the entire specification claims and drawings of which are incorporated herewith by reference.

TECHNICAL FIELD

The present invention relates to an improvement of an engine-driven generator formed by supporting on a frame an engine and a generator driven by the engine.

BACKGROUND ART

Such an engine-driven generator is already known, as disclosed, for example, in Publication 1 below.

Patent Publication 1: Japanese Patent Application Laid-open No. 11-36880

DISCLOSURE OF THE INVENTION

Problems to be Solved by the Invention

Since such an engine-driven generator is widely used as a temporary power source, etc. on a construction site or outdoors, when taking into account the influence on the work environment and the surroundings there is often a requirement for its running noise to be suppressed to as low a level as possible.

Therefore, in the engine-driven generator disclosed in Patent Publication 1, the frame itself is formed as a soundproofing case covering the engine, the generator, and auxiliary equipment therefor, thus reducing the running noise, but the soundproofing case not only increases the overall dimensions of the engine-driven generator but also increases the weight.

The present invention has been accomplished while taking such points into consideration, and it is an object thereof to provide an engine-driven generator that enables the running noise to be reduced while achieving a compact size by forming a frame in the shape of a framework having an open periphery.

Means of Solving the Problems

To attain the above object, according to a first aspect of the present invention, there is provided an engine-driven generator formed by supporting on a frame an engine and a generator driven by the engine, characterized in that the frame is formed as an open periphery framework type frame, within this frame a duct member is disposed around the outer periphery of the engine and the generator, the duct member defining a series of cooling air passages between itself and the engine and generator, a cooling fan is provided in the cooling air passage, the cooling fan being driven by the engine so as to generate cooling air flowing from the upstream end side to the downstream end side of the duct member in the cooling air passage, an intake box having an intake opening at an outer end thereof and housing an electrical component is connected to the upstream end of the duct member, and an exhaust box having an exhaust opening at an outer end thereof and housing an exhaust muffler of the engine is connected to the other end of the duct member.

According to a second aspect of the present invention, in addition to the first aspect, the intake box and the exhaust box are formed as a muffler expansion chamber.

According to a third aspect of the present invention, in addition to the second aspect, a fuel tank is disposed above the duct member, the fuel tank covering an upper face of the duct member throughout its length.

According to a fourth aspect of the present invention, in addition to either the first or second aspect, an assembly of the engine and the generator is resiliently supported on the frame, the duct member is fixedly supported on the assembly, the intake box is fixedly supported on the frame, and the duct member and the intake box are connected via a seal that allows relative displacement therebetween.

According to a fifth aspect of the present invention, in addition to any one of the first to third aspects, the generator is formed from a magnet generator that includes an outer rotor cantilever-supported by a crankshaft of the engine, and the cooling fan is mounted on an outer end face of the outer rotor.

According to a sixth aspect of the present invention, in addition to the first aspect, an intake control system of the engine and an air cleaner for cleaning intake air therefor are disposed outside the duct member, and an air inlet of the air cleaner is connected to the intake box.

According to a seventh aspect of the present invention, in addition to the first aspect, the upstream end of the duct member is connected to the intake box having the intake opening, an air cleaner of the engine is disposed outside the duct member, and an air inlet pipe of the air cleaner is connected to the intake box.

According to an eighth aspect of the present invention, in addition to the seventh aspect, an assembly of the engine and the generator is resiliently supported on the frame, the duct member and the air cleaner are fixedly supported on the assembly, the intake box is fixedly supported on the frame, the duct member and the intake box are connected via a first seal that allows relative displacement therebetween, and the intake box and the air inlet pipe of the air cleaner are connected via a second seal that allows relative displacement therebetween.

According to a ninth aspect of the present invention, in addition to the seventh aspect, an assembly of the engine and the generator is resiliently supported on the frame, the duct member is fixedly supported on the assembly, the air cleaner and the intake box are fixedly supported on the frame, the duct member and the intake box are connected via a first seal that allows relative displacement therebetween, and the engine and the air cleaner are connected via a flexible communicating tube that allows relative displacement therebetween.

According to a tenth aspect of the present invention, in addition to any one of the seventh to ninth aspects, a cylinder part of the engine is inclined toward one side of the crankcase, and at least part of the air cleaner extending along the axial direction of the crankshaft of the engine is disposed beneath the cylinder part.

According to an eleventh aspect of the present invention, in addition to any one of the seventh to ninth aspects, an electrical component is disposed within the intake box between the intake opening and a section where the intake box and the duct member are connected.

According to a twelfth aspect of the present invention, in addition to any one of the seventh to ninth aspects, the downstream end of the duct member is connected to the exhaust box having the exhaust opening, and an exhaust muffler of the engine is disposed in the exhaust box.

According to a thirteenth aspect of the present invention, in addition to the first aspect, the engine is resiliently supported on the frame, the duct member is fixedly provided on the engine and the generator within the frame, the duct member defining the series of cooling air passages between itself and the engine and generator, the cooling fan is disposed in the cooling air passage, the cooling fan being driven by the engine so as to generate a flow of cooling air in the cooling air passage, the intake box having the intake opening and housing the electrical component is fixedly mounted on the frame, and the intake box and an upstream part of the duct member are connected so as to be linked to each other via a first seal that allows relative displacement therebetween.

According to a fourteenth aspect of the present invention, in addition to the thirteenth aspect, an upstream end part of the duct member is projectingly disposed within the intake box so as to be in proximity to at least part of the electrical component.

According to a fifteenth aspect of the present invention, in addition to either the thirteenth or fourteenth aspect, a recoil type starter of the engine is disposed so that a rope pulley of the recoil type starter projects within the intake box, a starter rope extending from the rope pulley is taken outward from one side wall of the intake box, and an operating knob is connected to the outer end of the starter rope.

According to a sixteenth aspect of the present invention, in addition to either the thirteenth or fourteenth aspect, an air cleaner of the engine is disposed outside the duct member, and an air inlet of the air cleaner and the intake box are connected so as to be linked to each other via a second seal that allows relative displacement therebetween.

EFFECTS OF THE INVENTION

In accordance with the first aspect of the present invention, while the engine is running, due to rotation of the cooling fan within the duct member, outside air is taken into the intake box as cooling air, flows within the duct member, that is, the cooling air passage, passes through the interior of the exhaust box, and is discharged outside, and during this process the air can cool the electrical component within the intake box, cool the engine and the generator within the duct member, and cool the exhaust muffler within the exhaust box.

Furthermore, the duct member also functions as a soundproofing wall for cutting off operating noise generated by the engine, the generator, and the cooling fan, thus ensuring the quietness of the engine-driven generator.

Moreover, since the duct member, and the intake and exhaust boxes are mounted on the open framework type frame, compared with a conventional arrangement in which the entire engine-driven generator is covered by a soundproofing wall, not only can the engine-driven generator be made compact and lightweight, but it is also possible to arrange reinforcement for the carburetor, the air cleaner, etc. outside the duct member, thus enhancing the ease of maintenance thereof.

Furthermore, in accordance with the second aspect of the present invention, even if the operating noise of the engine, the generator, and the cooling fan is transmitted from the upstream and downstream ends of the duct member to the intake and exhaust boxes, the operating noise can be muffled effectively by utilizing the intake and exhaust boxes, and the quietness of the engine-driven generator can be further improved by a simple structure.

Moreover, in accordance with the third aspect of the present invention, the fuel tank forms, in cooperation with the duct member, a double soundproofing wall covering upper parts of the engine and the generator, it is possible to prevent effectively the operating noise of the engine and the generator from leaking upward, and the quietness of the engine-driven generator can be further improved by a simple structure.

Furthermore, in accordance with the fourth aspect of the present invention, while the engine is running, vibration occurring therein is absorbed by an elastic support part between the engine and the frame, and it is thereby possible to prevent the vibration from being transmitted to the frame or greatly reduce the vibration. Moreover, even if the vibration of the engine is transmitted to the duct member fixed thereto, the vibration is absorbed by the seal, thus preventing it from being transmitted to the intake box, and it is therefore possible for cooling air to efficiently flow from the intake box to the duct member without leaking.

Furthermore, in accordance with the fifth aspect of the present invention, the cooling fan, which has a large diameter corresponding to the diameter of the duct member, can be mounted simply by utilizing a large outer end face of the outer rotor, which is cantilever-supported by the crankshaft, thereby enhancing the effect of cooling the engine and the generator.

Moreover, in accordance with the sixth aspect of the present invention, during an intake stroke of the engine, since air within the intake box is taken in by the engine through the air cleaner and the intake control system, intake noise of the engine can be muffled effectively by the intake box, thereby contributing to a further improvement in the quietness of the engine-driven generator.

Furthermore, in accordance with the seventh aspect of the present invention, even if operating noise of the engine, the generator, and the cooling fan is transmitted from the upstream end of the duct member to the intake box, the operating noise can be muffled effectively by the intake box, and since, during an intake stroke of the engine, the air within the intake box is taken in by the engine through the air cleaner, the intake noise of the engine can also be muffled effectively by the intake box, thereby ensuring the quietness of the engine-driven generator.

Moreover, in accordance with the eighth aspect of the present invention, vibration while the engine is running is absorbed by an elastic support part between the engine and the frame, and it is thereby possible to prevent the vibration from being transmitted to the frame or greatly reduce the vibration. Furthermore, even if the vibration of the engine is transmitted to the duct member fixed thereto, the vibration is absorbed by the first and second seals, thus preventing it from being transmitted to the intake box, and it is therefore possible for air to efficiently flow from the intake box to the duct member and the air cleaner without leaking.

Moreover, in accordance with the ninth aspect of the present invention, vibration while the engine is running is absorbed by an elastic support part between the engine and the frame, and it is thereby possible to prevent the vibration from being transmitted to the frame or greatly reduce the vibration. Furthermore, relative displacement between the duct member and the intake box accompanying the vibration of the engine is absorbed by flexure of the seal, thereby preventing the vibration from being transmitted to the intake box. On the other hand, relative displacement between the engine and the air cleaner accompanying the vibration can be absorbed by flexure of the elastic communicating tube, and the air inlet pipe of the air cleaner can therefore be connected integrally to the intake box, thereby contributing to simplification of the structure.

Moreover, in accordance with the tenth aspect of the present invention, a relatively large capacity air cleaner can be installed while lowering the center of gravity of the engine-driven generator.

Furthermore, in accordance with the eleventh aspect of the present invention, the electrical component can be cooled effectively by the cooling air flowing within the intake box, and this electrical component acts as a soundproofing partition within the intake box, thus enhancing the muffling effect of the intake box.

Moreover, in accordance with the twelfth aspect of the present invention, it is possible to cool the exhaust muffler within the exhaust box and reduce the exhaust noise.

Furthermore, in accordance with the thirteenth aspect of the present invention, while the engine is running, vibration occurring therein is absorbed by an elastic support part between the engine and the frame, and it is thereby possible to prevent the vibration from being transmitted to the frame or greatly reduce the vibration. Moreover, even if the vibration of the engine is transmitted to the duct member fixed thereto, the vibration is absorbed by the first seal, thus preventing it from being transmitted to the intake box, and it is therefore possible for air to efficiently flow from the intake box to the duct member without leaking.

Furthermore, in accordance with the fourteenth aspect of the present invention, positioning the upstream end part of the duct member in proximity to the electrical component allows air around the electrical component to be taken in by the duct member effectively, and even if the electrical component is one that easily attains a relatively high temperature, it can be cooled effectively.

Moreover, in accordance with the fifteenth aspect of the present invention, an outer portion of the intake box on which the operating knob is disposed corresponds to substantially the outermost portion of the engine-driven generator, and pulling of the operating knob can easily be carried out without interfering with another object, thus achieving good starting operability.

Furthermore, in accordance with the sixteenth aspect of the present invention, during an intake stroke of the engine, since the air within the intake box is taken in by the engine through the air cleaner, intake noise of the engine can be muffled by the intake box effectively, thus contributing to the quietness of the engine-driven generator. Moreover, even if vibration of the engine is transmitted to the air cleaner, the vibration can be absorbed by the second seal, thus preventing it from being transmitted to the intake box, and it is therefore possible for air to flow efficiently from the intake box to the air cleaner without leaking.

The intake opening corresponds to first and second intake louvers 38*a* and 38*b* of an embodiment of the present invention, which will be described later, the exhaust opening corresponds to an exhaust louver 73, the electrical component corresponds to a control unit 53 and an inverter 54, the seal corresponds to a first seal 41, and the intake control system corresponds to a carburetor 44.

The above-mentioned object, other objects, characteristics, and advantages of the present invention will become apparent from an explanation of a preferred embodiment that will be described in detail below by reference to the attached drawings.

EXPLANATION OF REFERENCE NUMERALS AND SYMBOLS

1 Engine-Driven Generator
2 Frame
3 Engine
4 Generator
5 Fuel Tank
17 Crankshaft
23 Outer Rotor
26 Cooling Fan
27 Recoil Type Starter
31 Duct Member
31*a* Duct Member Upstream End Part (Starter Cover)
32 Cooling Air Passage
34 Intake Box
38*a* and 38*b* Intake Opening (First and Second Intake Louvers)
41 Seal (First Seal)
42 Second Seal
44 Intake Control System (Carburetor)
45 Air Cleaner
46 Elastic Communicating Tube
53 Electrical Component (Control Unit)
55 Electrical Component (Inverter)
68 Exhaust Box
73 Exhaust Opening (Exhaust Louver)
74 Exhaust Muffler
113 Starter Rope
114 Rope Pulley
117 Operating Knob

BEST MODE FOR CARRYING OUT THE INVENTION

A preferred embodiment of the present invention is explained below by reference to the attached drawings.

Embodiment 1

Figure 1:
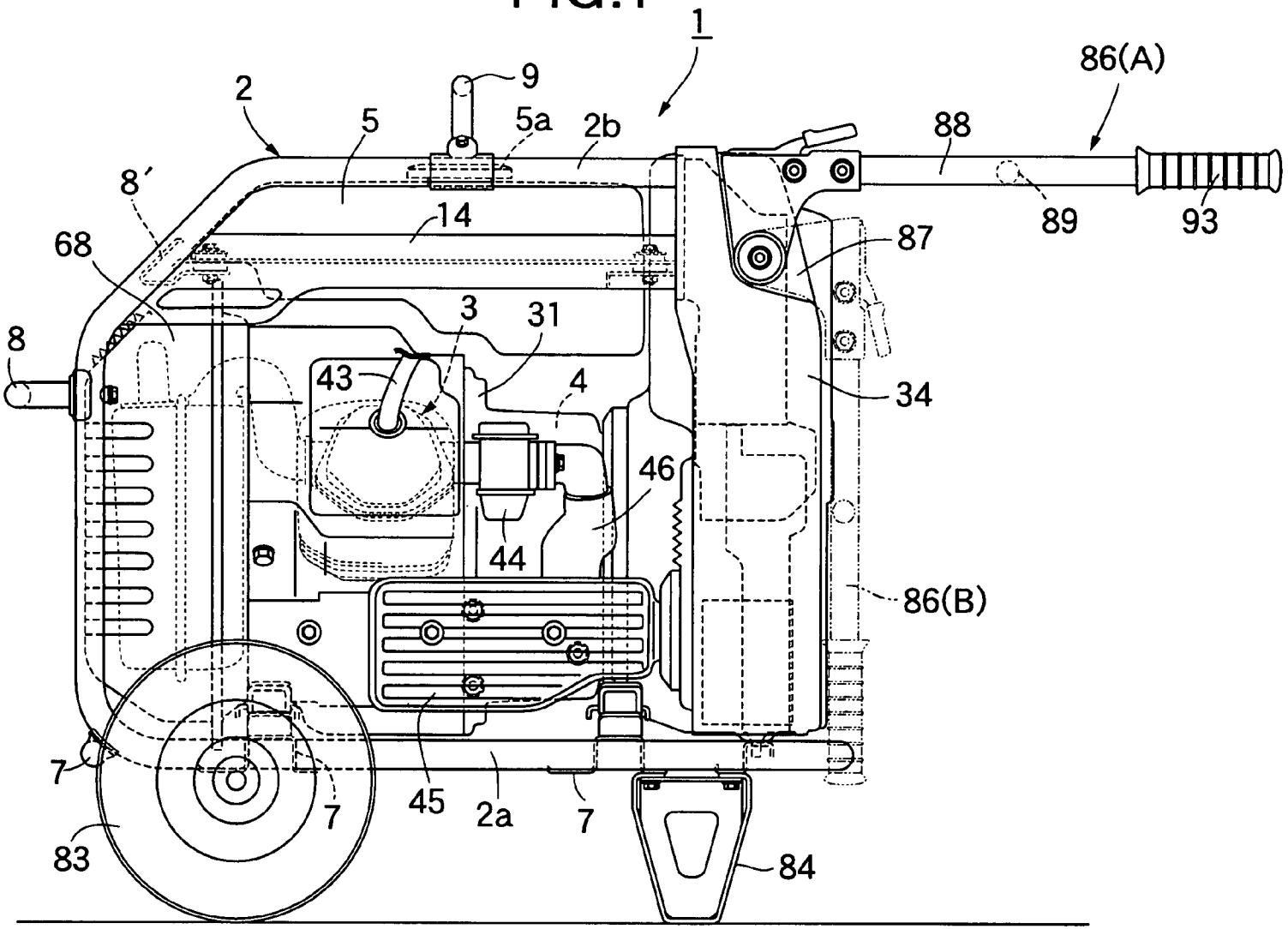
FIG. 1 is a side view of an engine-driven generator related to the present invention, showing a moving handle in a working state.
Figure 2:
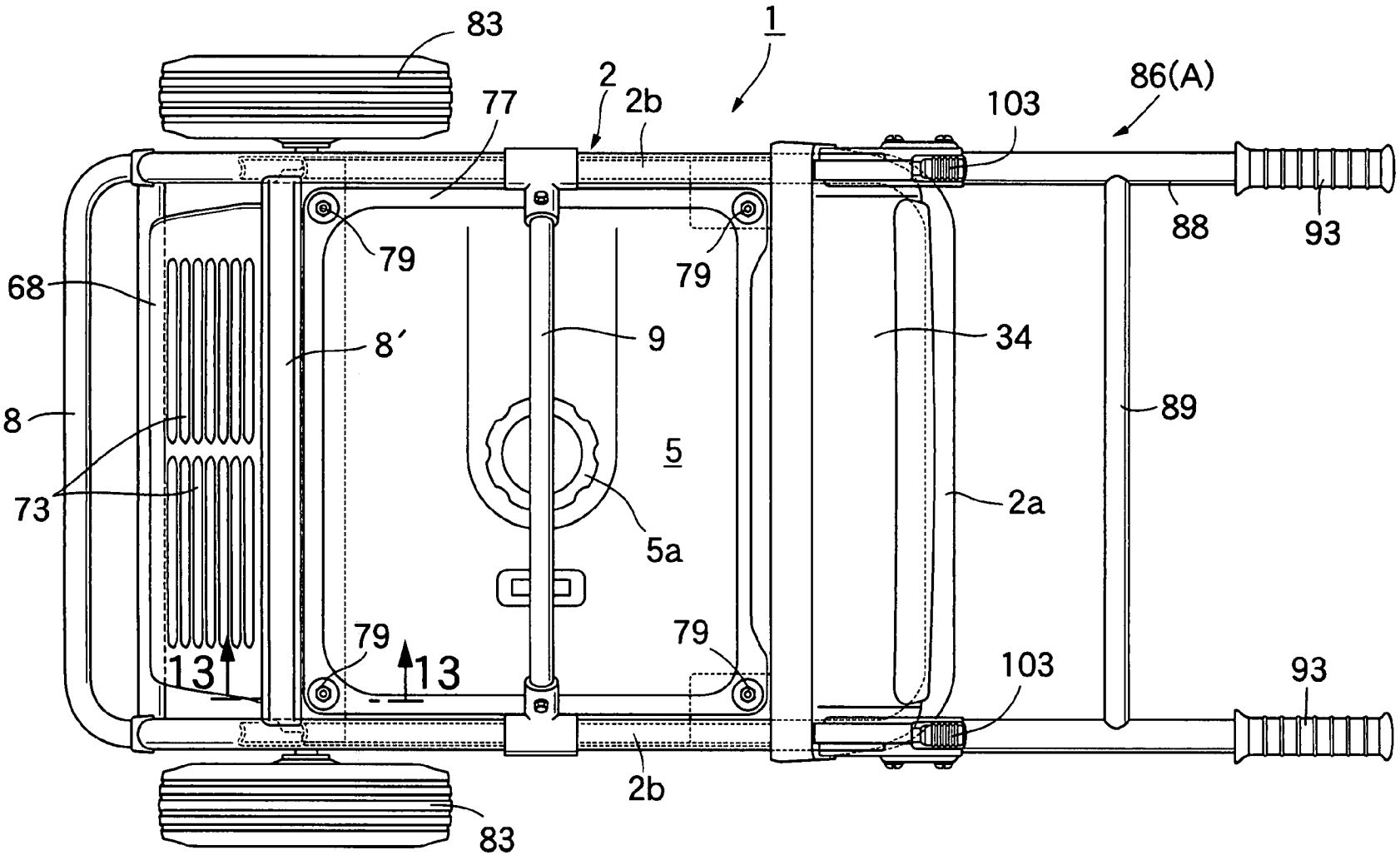
FIG. 2 is a plan view of the engine-driven generator.
Figure 3:
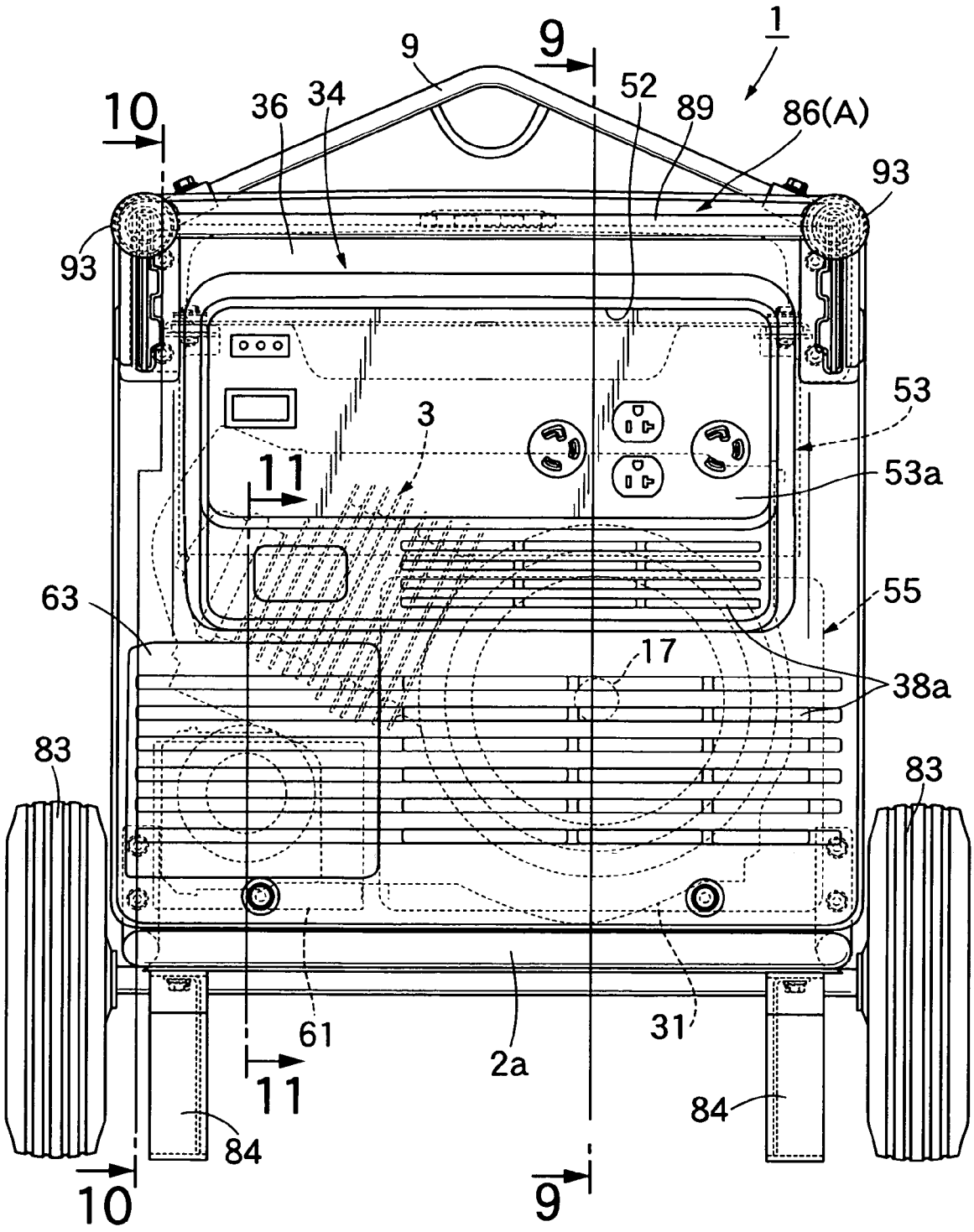
FIG. 3 is a front view of the engine-driven generator.
Figure 4:
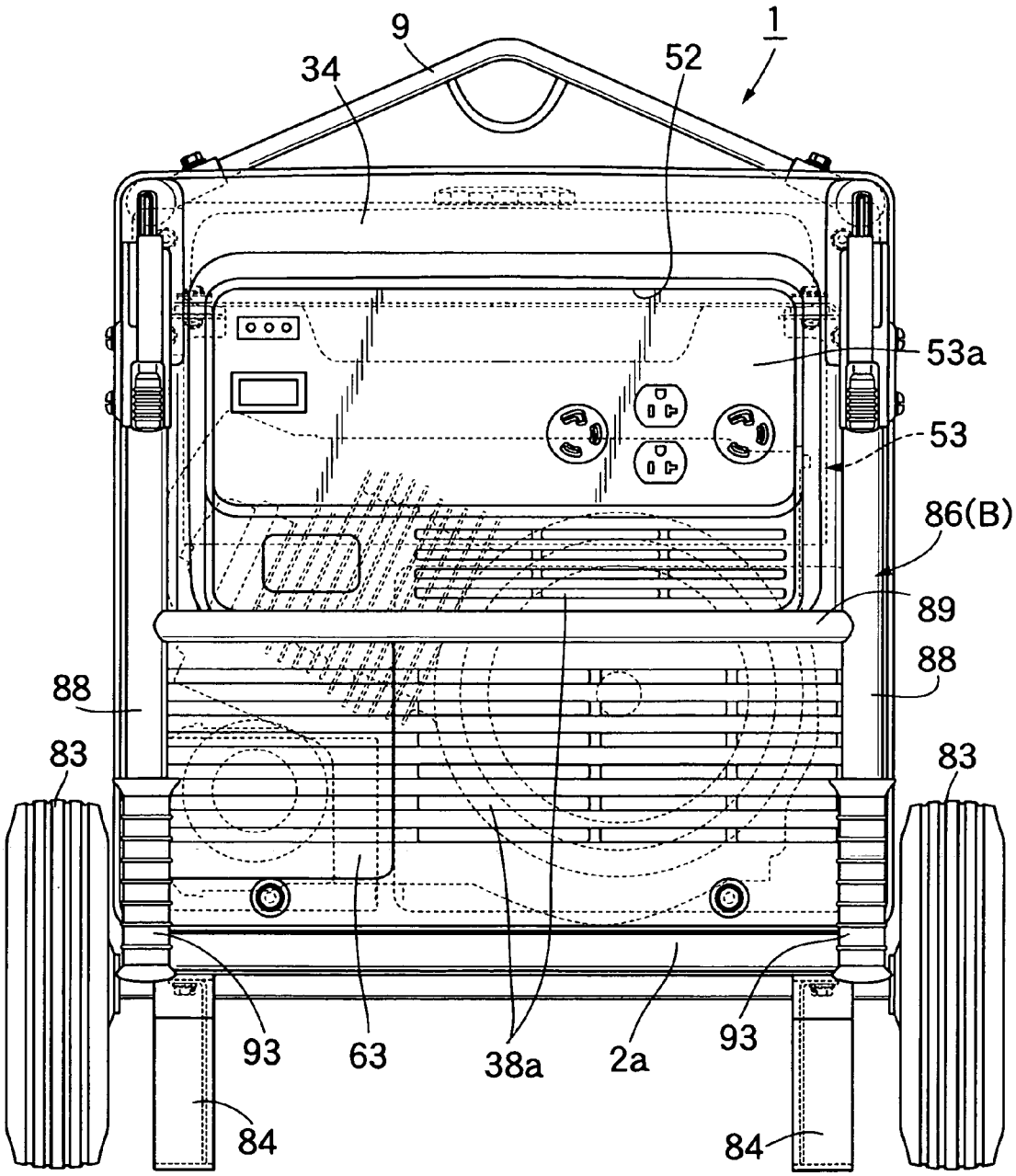
FIG. 4 is a front view of the engine-driven generator when the moving handle is in a stored state.

Referring firstly to FIG. 1 to FIG. 3, an engine-driven generator 1 of the present invention includes a frame 2, an engine 3 and a generator 4 that are resiliently supported on a lower part of the frame 2, a fuel tank 5 that is mounted on an upper part of the frame 2, and a control unit 53 for the engine 3 and the generator 4.

As shown in FIG. 1 to FIG. 3 and FIG. 8, the frame 2 is formed from a base frame 2*a* formed by bending a steel pipe into a U-shape, and left and right side frames 2*b* formed by bending steel pipes connected to opposite ends of the base frame 2*a* first upward and then horizontally, the side frames 2*b* forming, in cooperation with left and right side sections of the base frame 2*a*, a U-shape.

Provided on the base frame 2*a* are a plurality of lower cross members 7 providing a connection between the left and right side sections, provided between upper parts of vertical side sections of the side frames 2*b* is a middle cross member 8 providing a connection between the upper parts, and provided between inclined upper corners of the side frames 2*b* is an upper cross member 8' providing a connection between the corners. This middle cross member 8 has a longitudinally middle section projecting outward relative to the side frames 2*b* so as to function also as a bumper. Provided in upper side sections of the left and right side frames 2*b* is a hanger member 9 for providing a connection between middle parts of the upper side sections, the hanger member 9 being used for hanging and moving the engine-driven generator 1. In this way, the frame 2 is formed in the shape of a framework having an open periphery.

In the engine-driven generator 1, the side on which the U-shaped side frames 2*b* are open is defined as the front side, and the side on which the side frames 2*b* are closed, that is, the middle cross member 8 side, is defined as the rear side.

Figure 6:
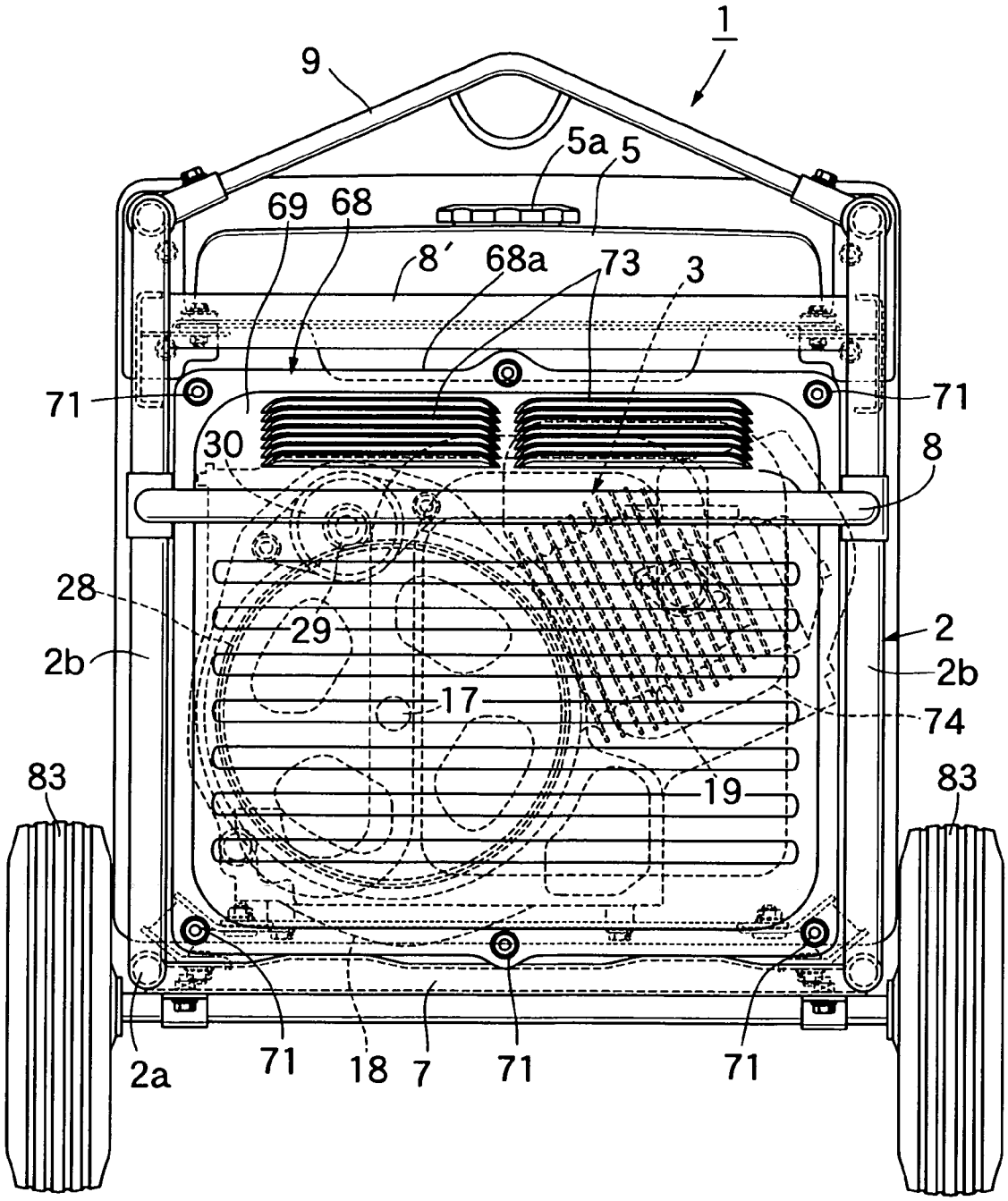
FIG. 6 is a rear view of the engine-driven generator.
Figure 7:
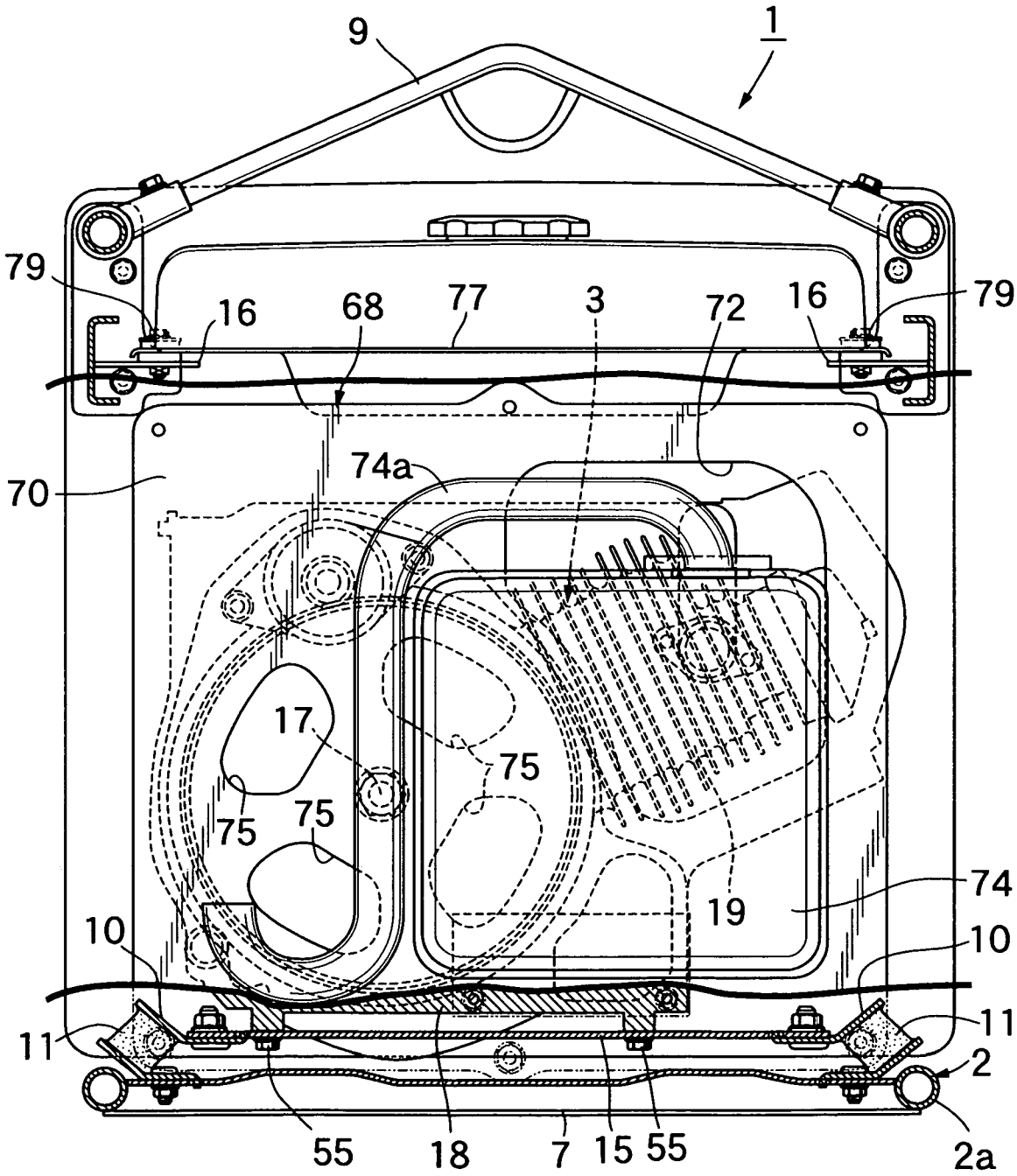
FIG. 7 is a rear view of the engine-driven generator, showing an exhaust box, part thereof being cut away.
Figure 8:
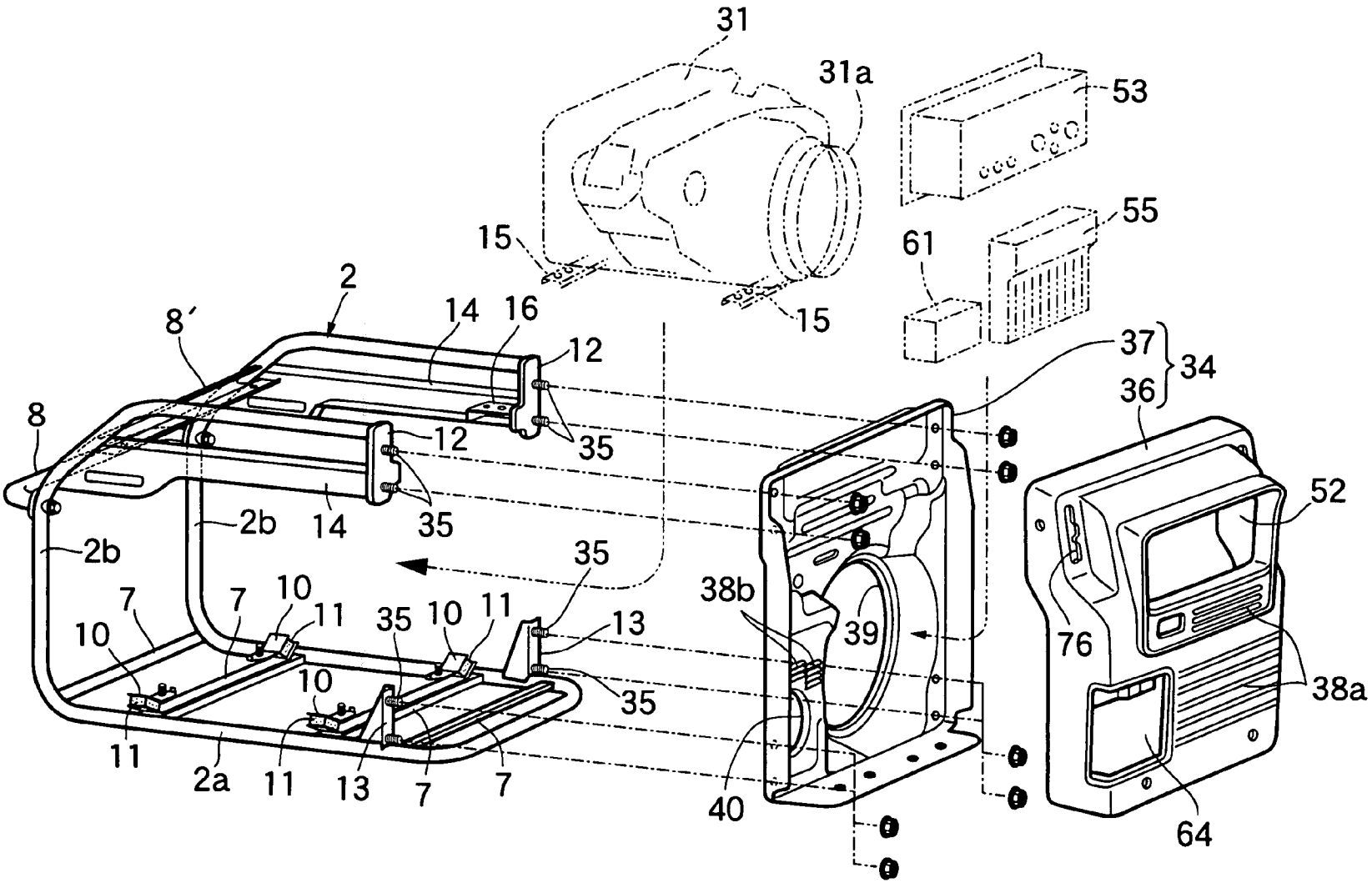
FIG. 8 is an exploded perspective view of part of the engine-driven generator.

In FIG. 6 to FIG. 8, among the lower cross members 7, two of the cross members 7 are equipped, via elastic members 11, with front and rear pairs of left and right support plates 10. Furthermore, provided on the left and right side frames 2*b* are upper and lower pairs of left and right brackets 12 and 13 disposed vertically on the front side of the frame 2, and connected to lower parts of the upper brackets 12 are reinforcing stays 14 extending forward from an upper end part of the vertical side section of the corresponding side frame 2*b*. Provided at front end parts of these reinforcing stays 14 are a pair of left and right bracket pieces 16.

Joined by bolts to the pairs of left and right support plates 10 are connecting plates 15 that provide a connection therebetween, and joined by a bolt 33 to these connecting plates 15 is a bottom wall of the engine 3 or a bottom wall of a duct member 31, which will be described later, joined to the engine 3. In this way, an assembly of the engine 3 and the generator 4 is resiliently supported on the frame 2.

Figure 9:
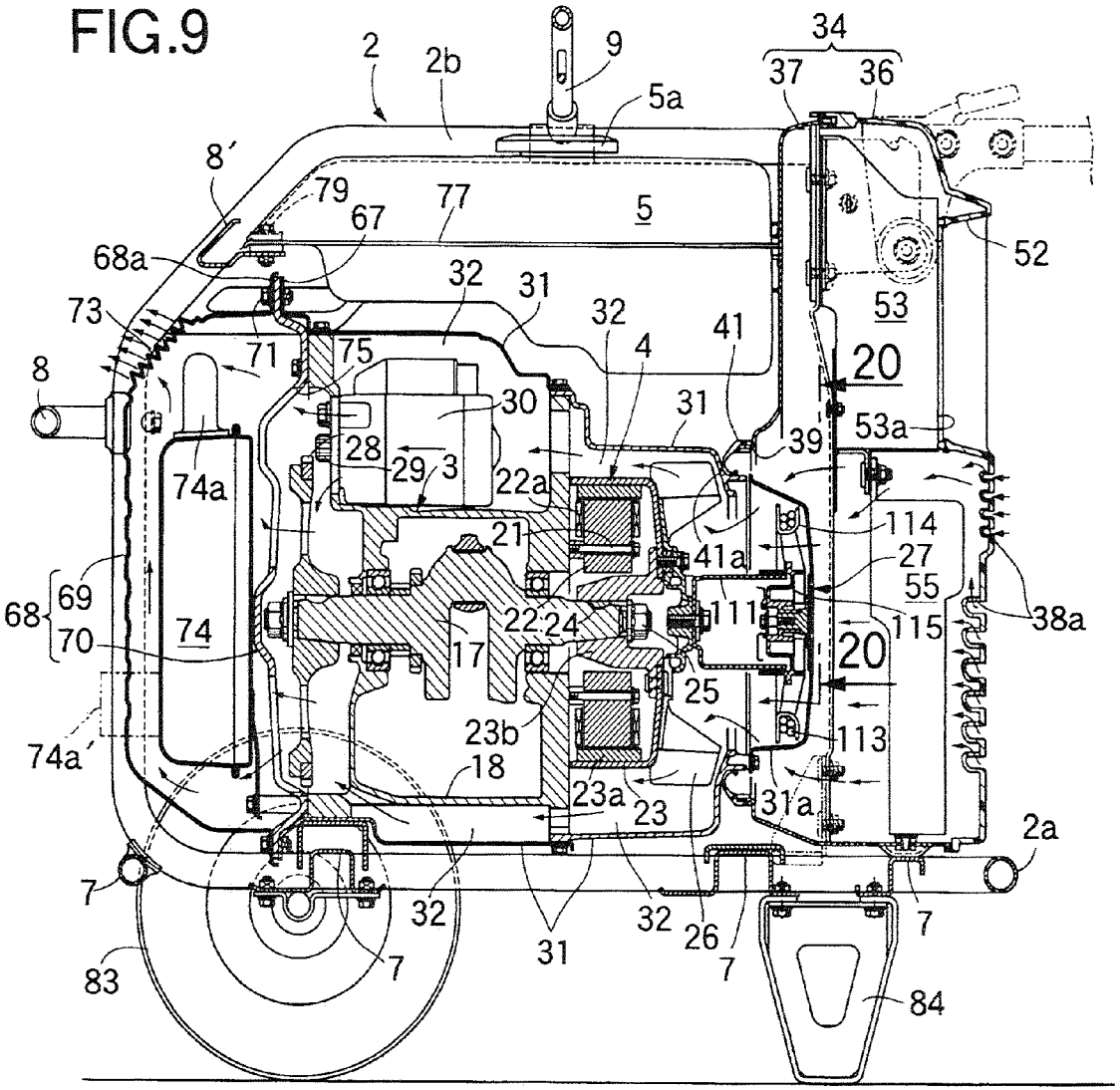
FIG. 9 is a sectional view along line 9-9 in FIG. 3.
Figure 10:
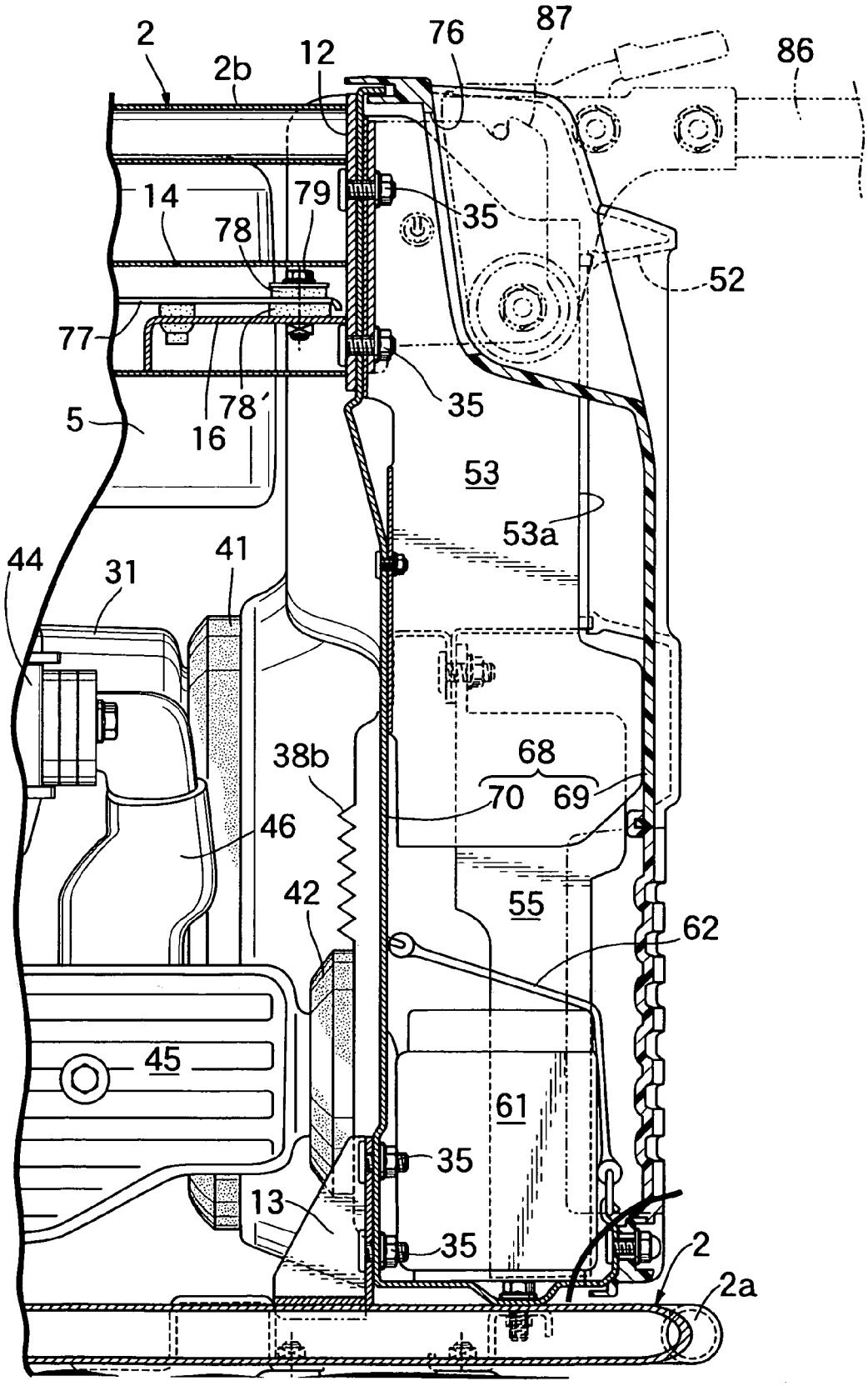
FIG. 10 is a sectional view along line 10-10 in FIG. 3.
Figure 11:
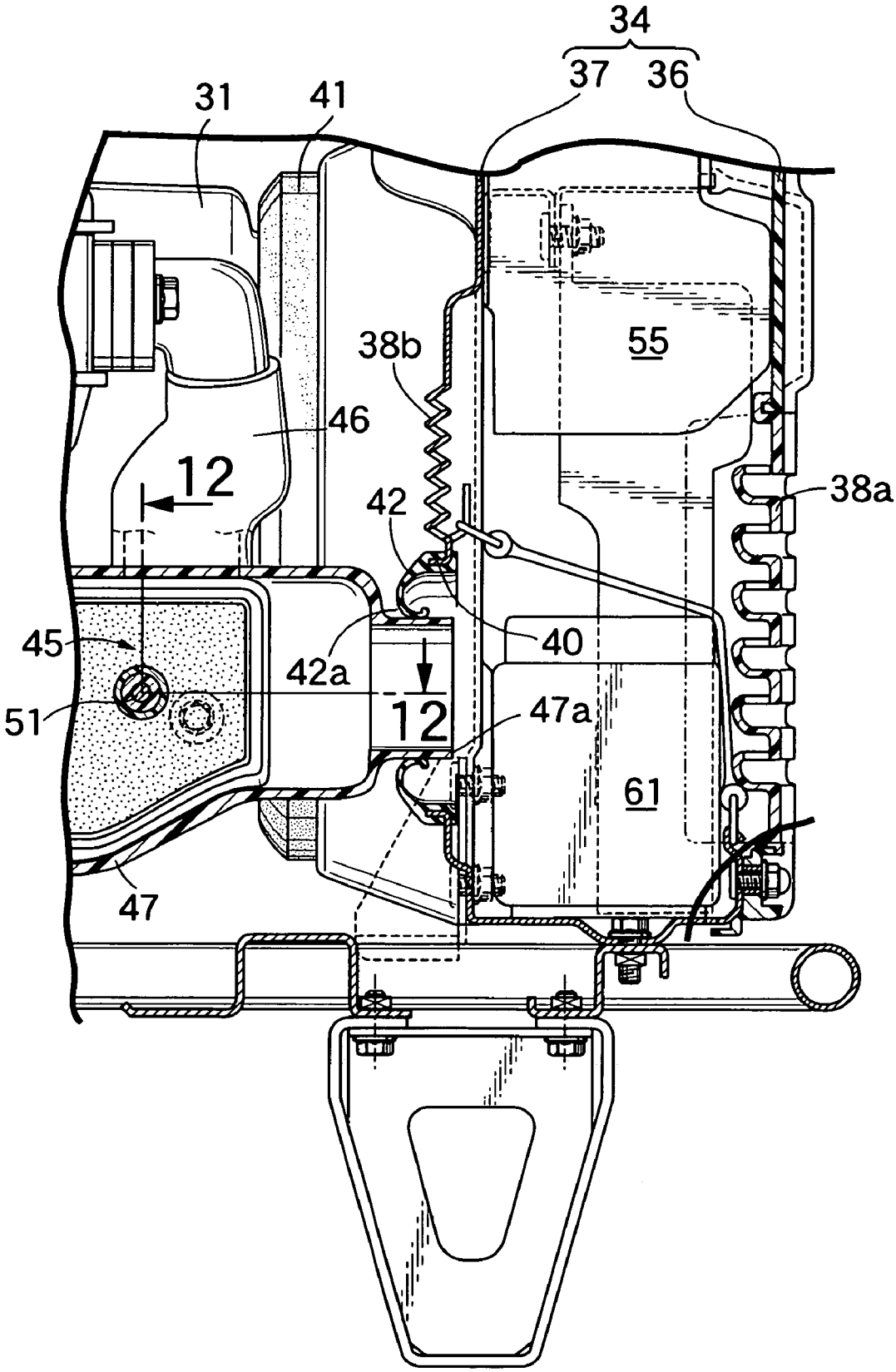
FIG. 11 is a sectional view along line 11-11 in FIG. 3.

In FIG. 9 to FIG. 11, the duct member 31 is disposed on the outer periphery of the engine 3 and the generator 4, the duct member 31 defining a series of cooling air passages 32 between itself and the engine 3 and generator 4 while surrounding a cooling fan 26, and in the cooling air passages 32 cooling air flows from the upstream end on the cooling fan 26 side to the downstream end on the engine 3 rear face side accompanying rotation of the cooling fan 26. In order to make production easy, the duct member 31 is segmented into a plurality of sections, and appropriate positions thereof are joined by bolting to an outer peripheral face of the engine 3.

As shown in FIG. 3 and FIG. 9, the engine 3 is of a 4-cycle type, a crankshaft 17 is disposed along the fore-and-aft direction of the engine-driven generator 1, a cylinder part 19 thereof projects obliquely upward to one side from a crankcase 18 housing and supporting the crankshaft 17, and an intake port and an exhaust port open on a front face and a rear face respectively of the cylinder part 19.

The generator 4 is formed from a stator 22 that is secured to a front end face of the crankcase 18 via a plurality of bolts 21 and includes a plurality of stator coils 22*a*, and an outer rotor 23 that is secured to a front end part of the crankshaft 17 running through a front end wall of the crankcase 18 and extending forward and that has a plurality of permanent magnets 23*a* arranged and fixedly provided on an inner peripheral face, that is, the generator is an outer rotor type multi-pole magnet generator. The outer rotor 23 includes a hub 23*b* surrounded by the stator 22, and this hub 23*b* is taper-fitted onto an end part of the crankshaft 17 and secured to the end part of the crankshaft 17 via a key 24 and a nut 25. In this way, the outer rotor 23 is cantilever-supported on the crankshaft 17.

Mounted on an outer end face of the outer rotor 23 are a centrifugal type cooling fan 26 having a diameter that is larger than that of the outer rotor 23 and corresponds to the inner diameter of the duct member 31, and a recoil type starter 27 projecting forward of the cooling fan 26.

As shown in FIG. 6 and FIG. 9, a ring gear 28 is secured to a rear end part of the crankshaft 17, and a starter motor 30 driving the ring gear 28 via a pinion 29 and an overrunning clutch (not illustrated) is mounted on an upper part of the crankcase 18.

In FIG. 1 to 5 and FIG. 8 to FIG. 11, disposed in a front part of the frame 2 is a rectangular intake box 34 for shaping the contours of a front face of the engine-driven generator 4 when viewed from the front. This intake box 34 is formed from a synthetic resin box main body 36 having an open rear face, and an end plate 37 made of a steel plate joined to the box main body 36 so as to close the open rear face. The end plate 37 is detachably secured via a plurality of bolts 35 to the brackets 12 and 13 as a reinforcing member for the frame 2, and the box main body 36 is detachably joined by bolting to the end plate 37.

As hereinbefore described, since the frame 2 is formed by making, using one steel pipe, the U-shaped base frame 2*a* and the pair of left and right side frames 2*b* sharing the left and right side sections of the base frame 2*a* to form a U-shape and by joining the two side frames 2*b* via the plurality of cross members 7, 8, and 8', the structure of the frame 2 is extremely simple and, moreover, since the frame 2 is reinforced by the intake box 34 detachably connected to its open front end part, the weight of the frame 2 can be reduced.

Dismantling the intake box 34 from the frame 2 enables the engine 3 and the generator 4 to be detached through the opened front side of the frame 2, thus making the maintenance thereof easy.

A first intake louver 38*a* is provided on the front face of the box main body 36; moreover, the end plate 37 is provided with a second intake louver 38*b*, a large diameter first connection opening 39 adjacent to the upstream end of the duct member 31, and a small diameter second connection opening 40, the peripheral edge of the first connection opening 39 is equipped with an annular first seal 41 made of an elastic material such as rubber, and a highly flexible annular seal lip 41*a* of the first seal 41 is fitted in an airtight manner around the outer periphery of the duct member 31. This first seal 41 links the intake box 34 and the duct member 31 while allowing relative displacement between the duct member 31 and the intake box 34 by virtue of elastic deformation of the seal lip 41*a*. An upstream end part of the duct member 31 is formed from a starter cover 31*a*, which will be described later, so as to project within the intake box 34, and an end wall and a peripheral wall of the starter cover 31*a* are provided with a large number of vents 116*a* and 116*b* (see FIG. 20). The intake box 34 has a cross-sectional area that is larger than the total aperture area of the vents 116*a* and 116*b*, thus forming a muffler expansion chamber.

Figure 20:
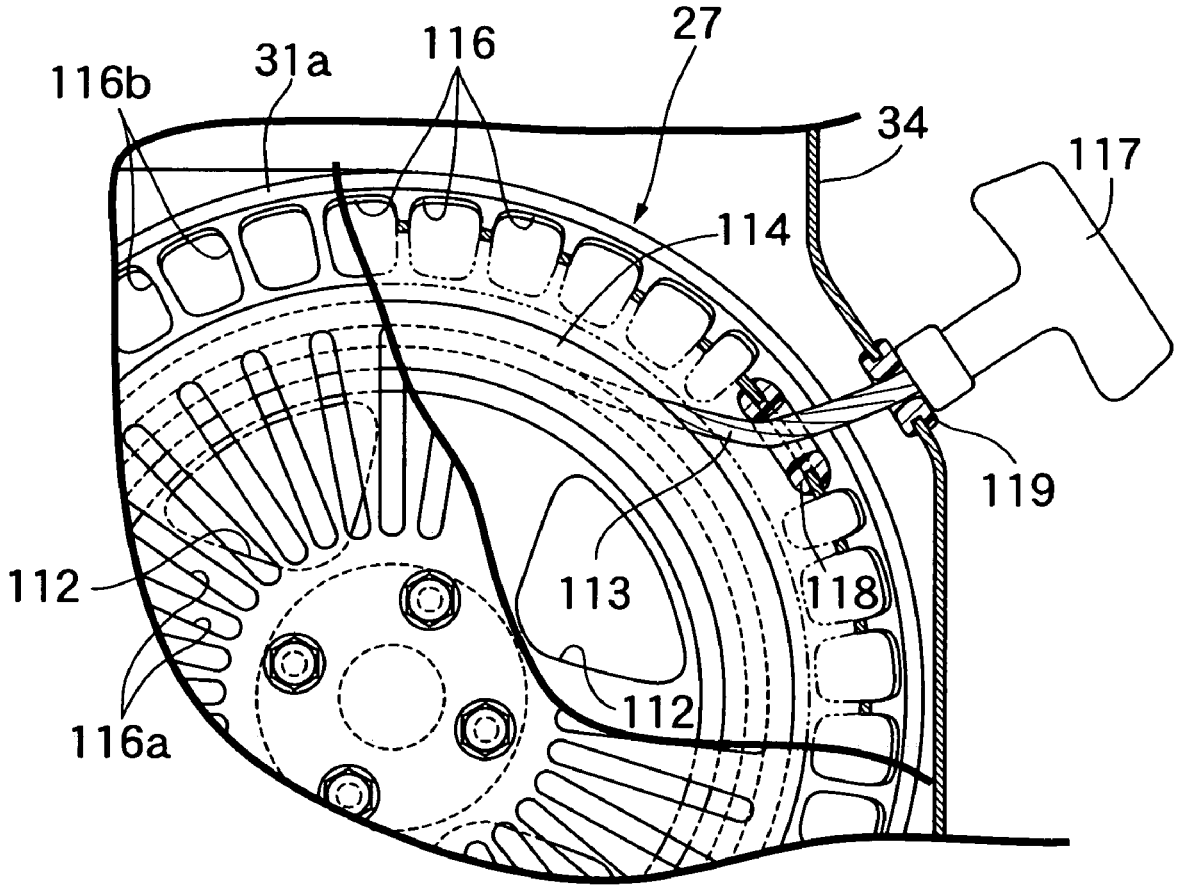
FIG. 20 is a sectional view along line 20-20 in FIG. 9.

In FIG. 9 and FIG. 20, the recoil type starter 27 includes a cup-shaped driven member 111, the starter cover 31*a*, which is bowl-shaped, a rope pulley 114, and a one-way clutch 115, the driven member 111 being secured to the outer end face of the outer rotor 23, the starter cover 31*a* being joined to the upstream end of the duct member 31 so as to cover it, the rope pulley 114 being axially and rotatably supported on an inner wall of the starter cover 31*a* and having a starter rope 113 wound therearound, the one-way clutch 115 being provided between the rope pulley 114 and the driven member 111 and only providing a connection between the rope pulley 114 and the driven member 111 when the rope pulley 114 is rotated forward by being pulled by the starter rope 113, and the rope pulley 114 being urged in a backward direction by a return spring (not illustrated). A large number of vents 112 are formed in the rope pulley 114 so that the rope pulley 114 does not interfere with the flow of cooling air within the duct member 31.

The starter rope 113 is taken outside the intake box 34 through grommet-shaped rope guides 118 and 119 provided on side walls of the starter cover 31*a* and the intake box 34 respectively, and the outer end of the starter rope 113 is connected to an operating knob 117. This operating knob 117 is supported on the outer end of the rope guide 119, which is on the outer side, when it is at a retracted position.

In this way, since an outer portion of the intake box 34 where the operating knob 117 of the recoil type starter 27 is disposed corresponds to substantially the outermost portion of the engine-driven generator 1, the operating knob 117 can easily be pulled without interfering with another object, and the starting operability is good.

In FIG. 1 and FIG. 10 to FIG. 12, a carburetor 44 is mounted on a front face of the cylinder part 19 of the engine 3. This carburetor 44 runs through a side wall of the duct member 31 and is exposed outside the duct member 31, and an air cleaner 45 similarly disposed outside the duct member 31 is connected to an intake passage entrance of the carburetor 44 via an elastic communicating tube 46 made of an elastic material such as rubber. Furthermore, a high tension cord 43 connected to a spark plug of the engine 3 runs through the side wall of the duct member 31 and is taken outside.

As shown in FIG. 1, the air cleaner 45 has a substantially rectangular shape that is long in the axial direction of the crankshaft 17 of the engine 3 when viewed from the side, and is disposed so that at least part of the air cleaner 45 is beneath the cylinder part 19, which is inclined slightly upward on one side of the crankcase 18. By so doing, it becomes possible to arrange the relatively large capacity air cleaner 45 while lowering the center of gravity of the engine-driven generator 1.

Figure 12:
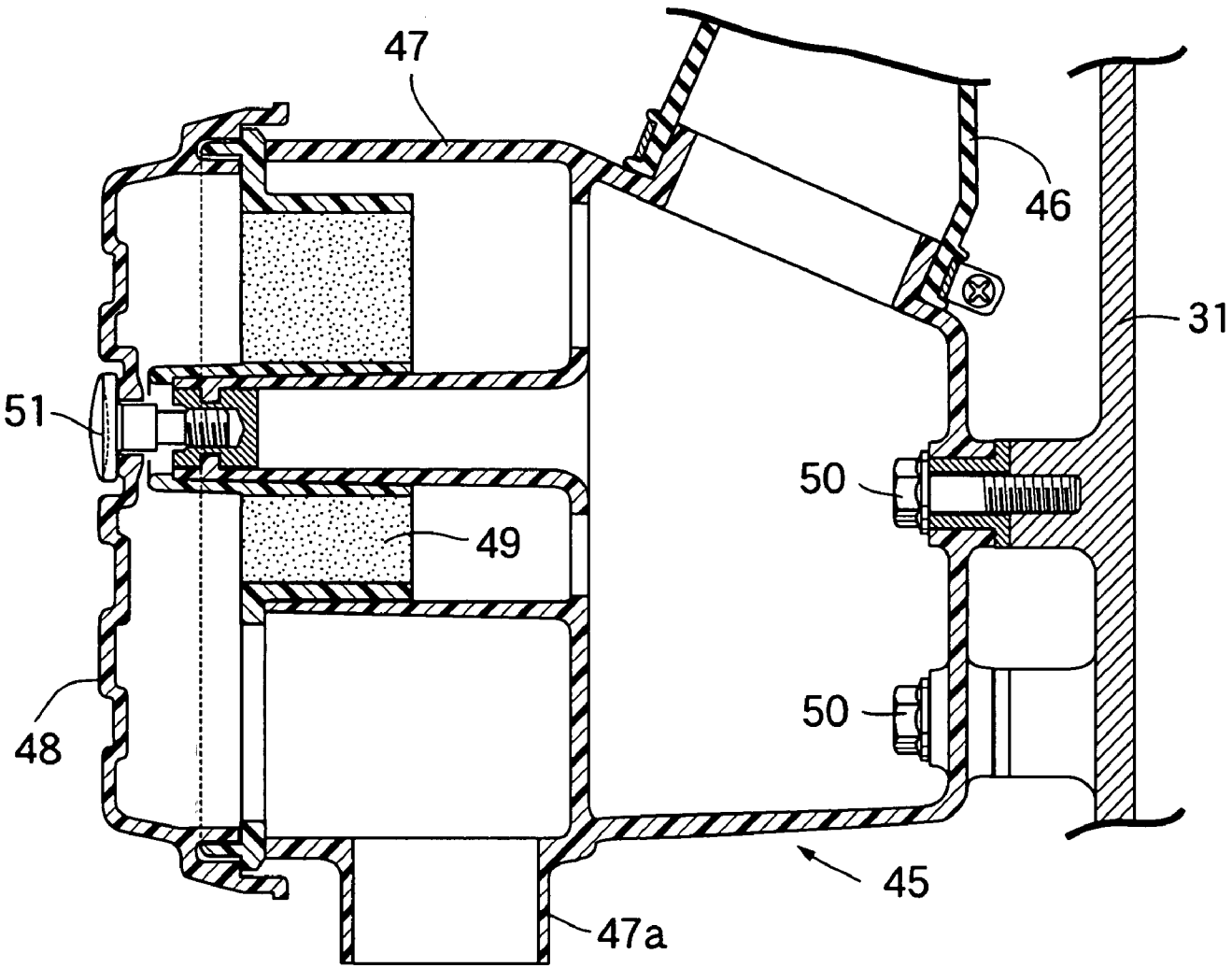
FIG. 12 is a sectional view along line 12-12 in FIG. 11.

As clearly shown in FIG. 11 and FIG. 12, this air cleaner 45 is formed from a cleaner case 47, a case cover 48, and a cleaner element 49, the cleaner case 47 being secured by a bolt 50 to an outer face of the duct member 31 and having an open outer face, the case cover 48 being joined to the cleaner case 47 by a bolt 51 so as to close the open face of the cleaner case 47, and the cleaner element 49 being held between the cleaner case 47 and the case cover 48. The cleaner case 47 has an integral air inlet pipe 47*a* communicating with the uncleaned side of the cleaner element 49.

The peripheral edge of the second connection opening 40 is equipped with an annular second seal 42 made of an elastic material such as rubber, and a highly flexible annular seal lip 42*a* of the second seal 42 is fitted around the outer periphery of the 47*a* of the air cleaner 45. This second seal 42 links the duct member 31 resiliently supported on the frame 2 via the engine 3 and the intake box 34 fixedly supported on the frame 2 while allowing relative displacement between the intake box 34 and the air cleaner 45 by virtue of elastic deformation of the seal lip 42*a*.

Figure 5:
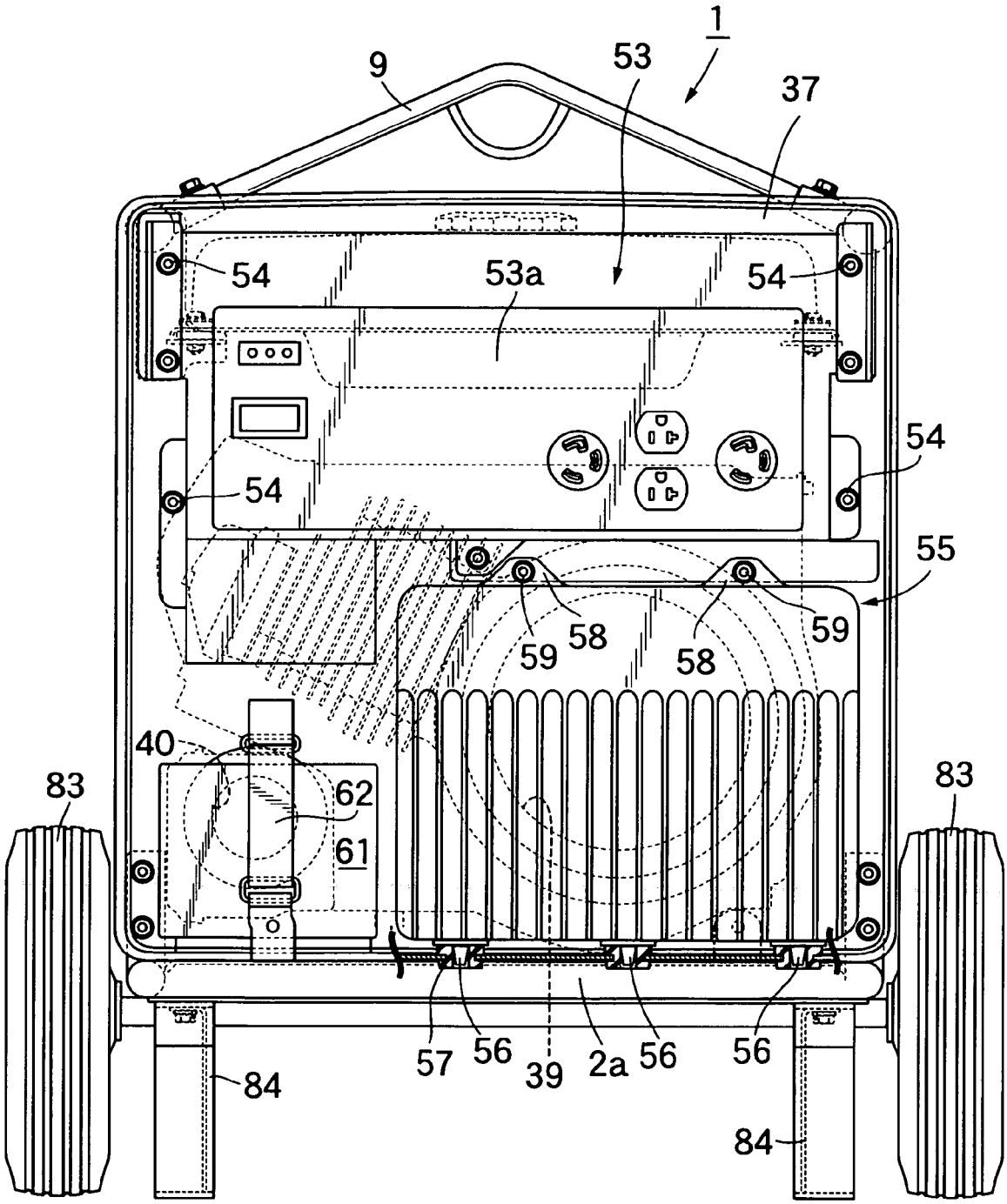
FIG. 5 is a front view of the engine-driven generator in a state in which a box main body of an intake box is detached.

In FIG. 3, FIG. 5 and FIG. 9, an access window 52 is provided on an upper part of a front face of the intake box 34, and an operation panel 53*a* of a control unit 53 for the engine 3 and the generator 4, which is disposed above the first connection opening 39 within the intake box 34, faces the access window 52. The control panel 53*a* is secured to an inner face of a rear wall of the intake box 34 via a bolt 54.

Within the intake box 34, the control unit 53 and an inverter 55 are disposed between the first intake louver 38*a* and the first connection opening 39, and a battery 61 is disposed between the first intake louver 38*a* and the second connection opening 40. In particular, the upstream end part of the duct member 31, which is disposed so as to project from the first connection opening 39 into the intake box 34, that is, the starter cover 31*a*, is disposed in proximity to a back face of the inverter 55.

The inverter 55 (see FIG. 5 in particular) is mounted on the intake box 34 by supporting a plurality of support shafts 56 projectingly provided on a lower end face of the inverter 55 on a base wall of the intake box 34 via grommets 57, and joining a plurality of ear pieces 58 at the upper end of the inverter 55 to the end plate 37 of the intake box 34 via bolts 59. In this arrangement, a sufficient ventilation gap is provided around the inverter 55 so as not to prevent air from flowing from the first and second intake louvers 38*a* and 38*b* to the first and second connection openings 39 and 40.

The battery 61 is retained on the end plate 37 by a rubber band 62. In this arrangement, a sufficient ventilation gap is provided around the battery 61 so as not to prevent air from flowing from the first and second intake louvers 38*a* and 38*b* to the second connection opening 40. For inspection of the battery 61, an inspection window 64 (see FIG. 8) that can be closed by a lid 63 is provided on a front wall of the intake box 34.

As clearly shown in FIG. 9, a mounting flange 67 is formed at the downstream end of the duct member 31, and an exhaust box 68 is mounted on the mounting flange 67. The exhaust box 68 is formed from a box main body 68 and an end plate 70, the box main body 68 having an exhaust louver 73 in an upper part of its rear face and having an open front face, the end plate 70 being joined to a flange part 68*a* of the box main body 69 so as to close the open face thereof, and the end plate 70 and the flange part 68*a* being secured to the mounting flange 67 via a plurality of bolts 71. Large and small through holes 72 and 75 (see FIG. 7) are bored in the end plate 70 of the exhaust box 68, and the downstream end of the duct member 31 communicates with the interior of the exhaust box 68 via these through holes 72 and 75. This exhaust box 68 has a cross-sectional area that is sufficiently larger than the aperture area of the through holes 72 and 75, thus forming a muffler expansion chamber.

This exhaust box 68 houses an exhaust muffler 74 and an outlet pipe 74*a* thereof, the exhaust muffler 74 being mounted on a rear face of the cylinder part 19 of the engine 3, and the end of the outlet pipe 74*a* opens at a long distance from the exhaust louver 73 of the exhaust box 68. A sufficient ventilation gap is provided around the exhaust muffler 74 so as to allow cooling air to flow from each of the through holes 72 and 75 to the exhaust louver 73.

As shown in FIG. 1, FIG. 7, FIG. 9, FIG. 13, and FIG. 14, the fuel tank 5, which includes a fuel filler hole cap 5*a* on an upper wall, is disposed above the duct member 31 covering the engine 3 and the generator 4. This fuel tank 5 has a substantially square shape when viewed from above and covers the whole length of an upper face of the duct member 31, and four corners of a mounting flange 77 projectingly provided on the outer periphery of the fuel tank 5 are detachably mounted, together with elastic members 78 and 78' disposed above and beneath the corners, on the upper cross member 8' and the bracket pieces 16 of the frame 2 via bolts 79. In this way, the fuel tank 5 is resiliently supported on the frame 2.

Figure 13:
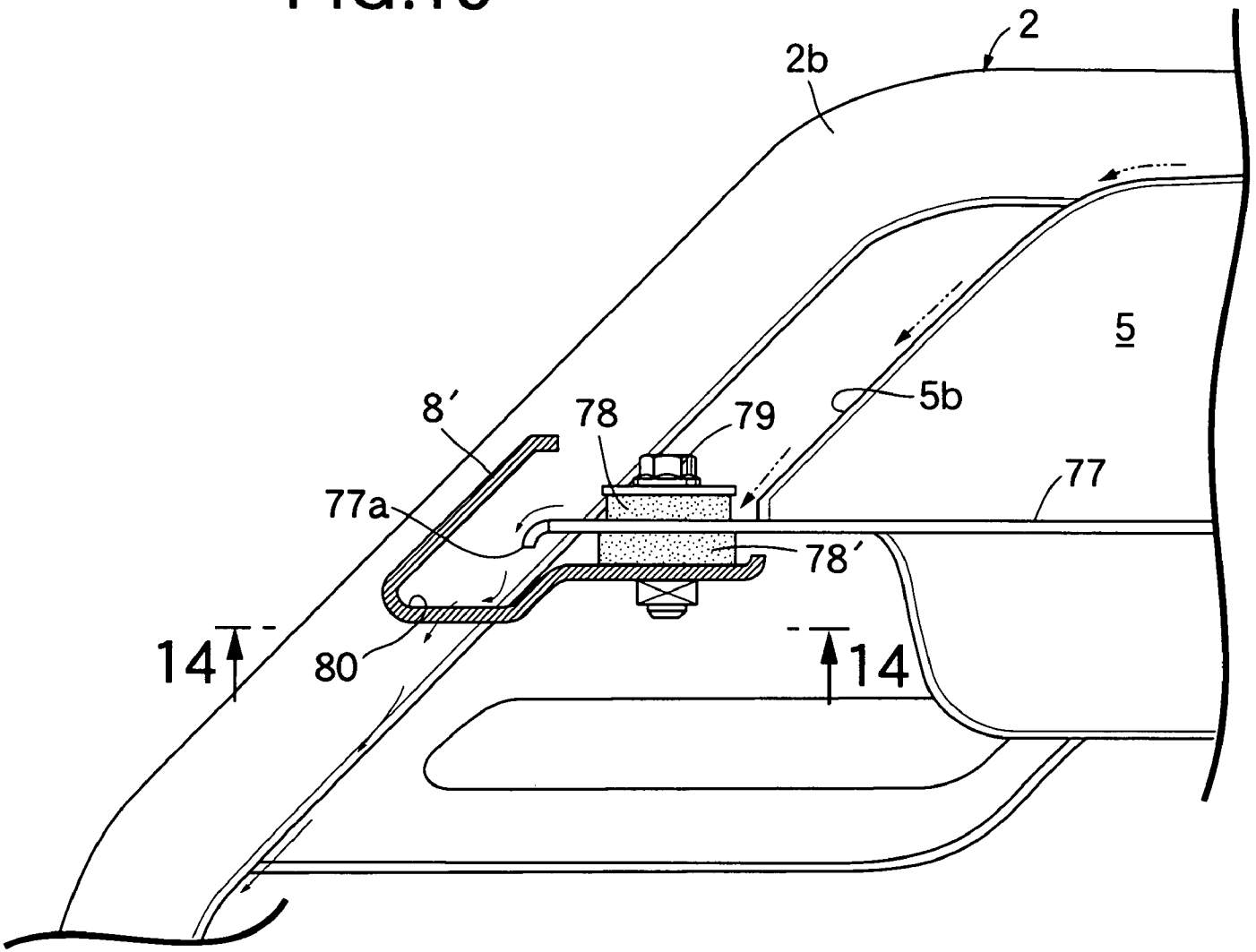
FIG. 13 is a sectional view along line 13-13 in FIG. 2.
Figure 14:
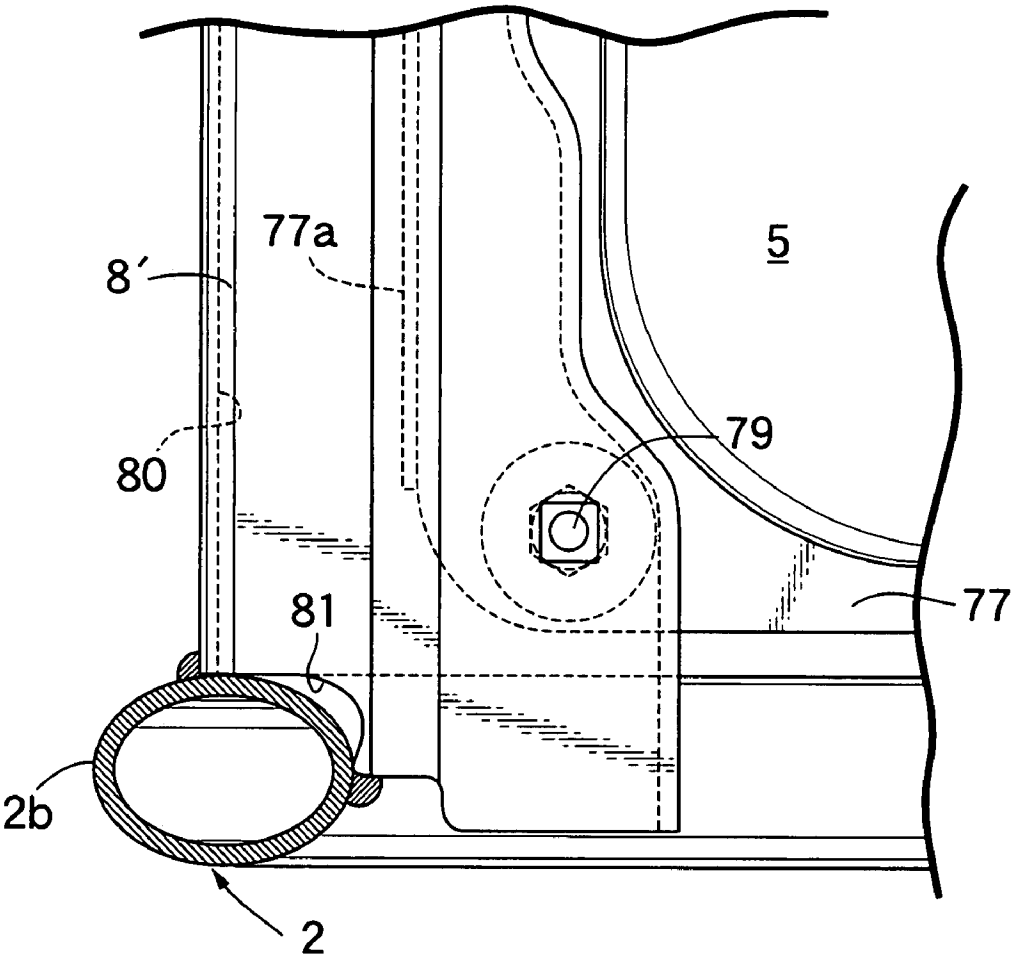
FIG. 14 is a sectional view along line 14-14 in FIG. 13.
Figure 15:
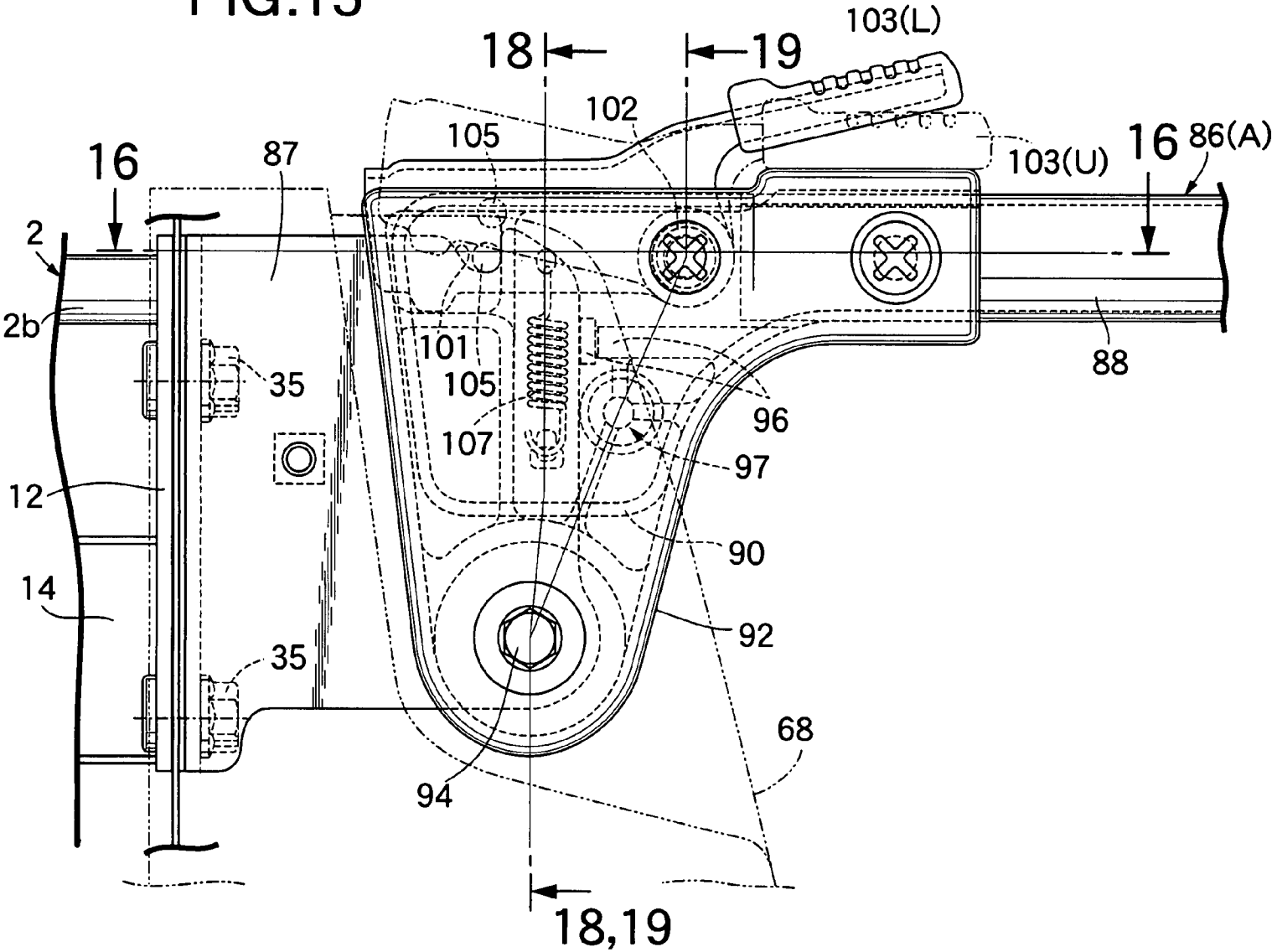
FIG. 15 is an enlarged view of the moving handle part of FIG. 1.
Figure 16:
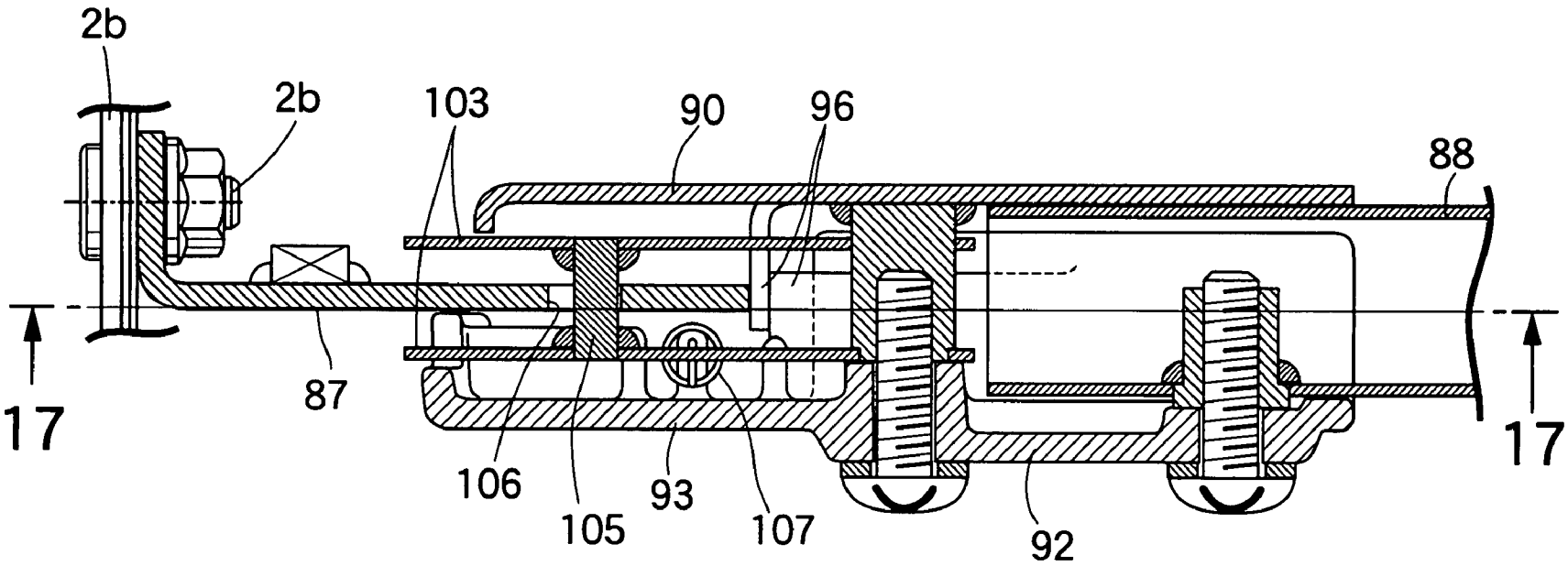
FIG. 16 is a sectional view along line 16-16 in FIG. 15.
Figure 17:
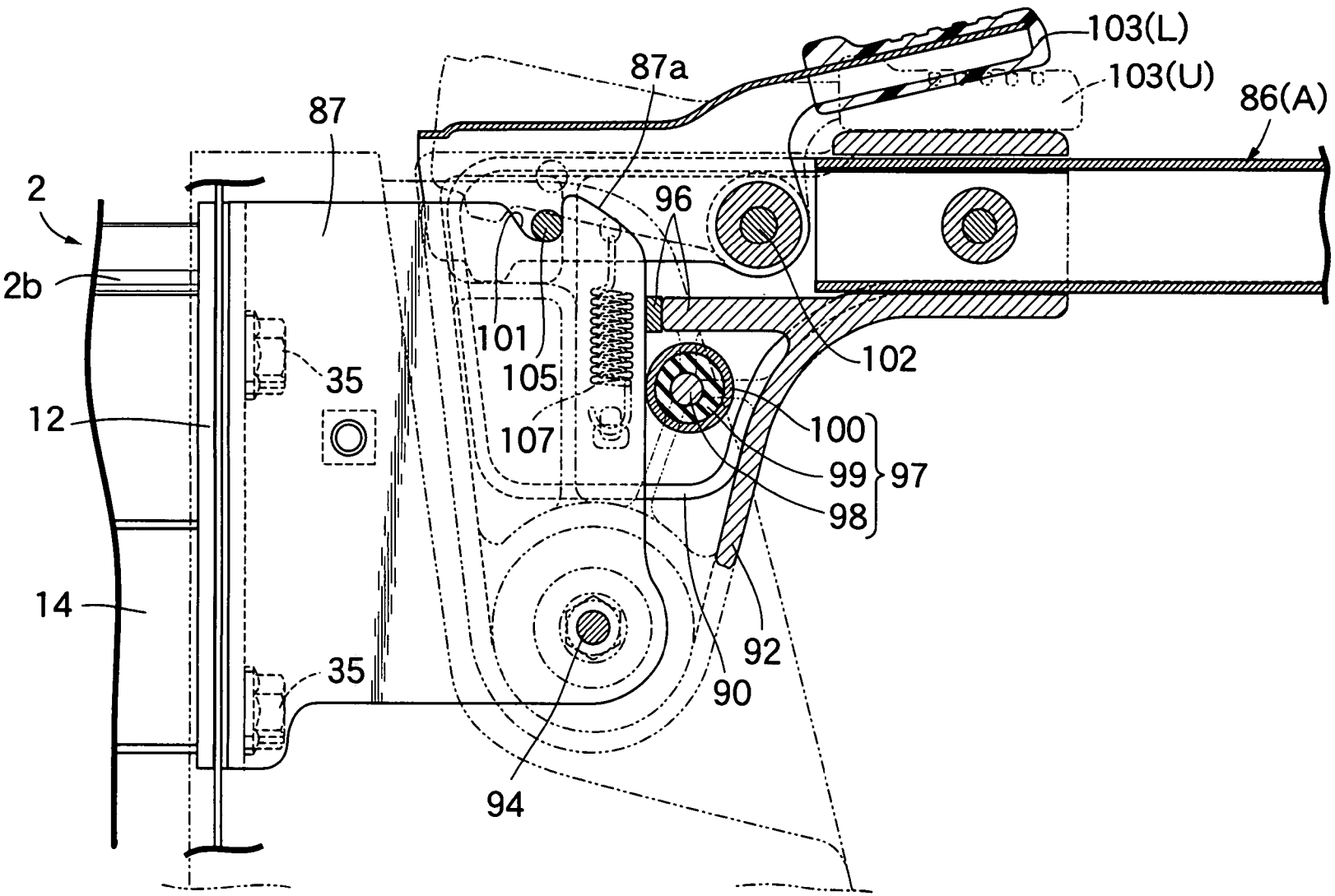
FIG. 17 is a sectional view along line 17-17 in FIG. 16.
Figure 18:
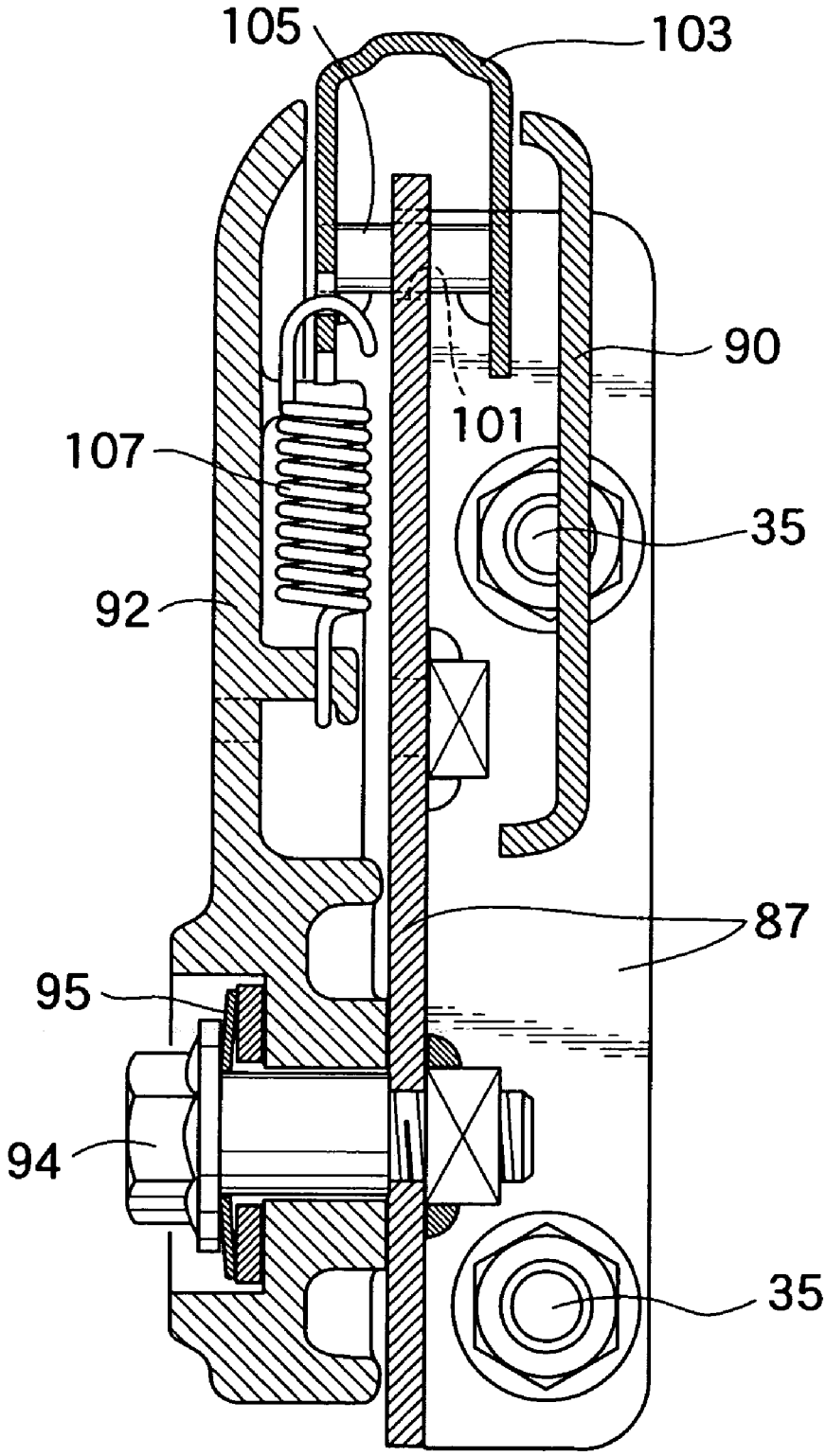
FIG. 18 is a sectional view along line 18-18 in FIG. 15.
Figure 19:
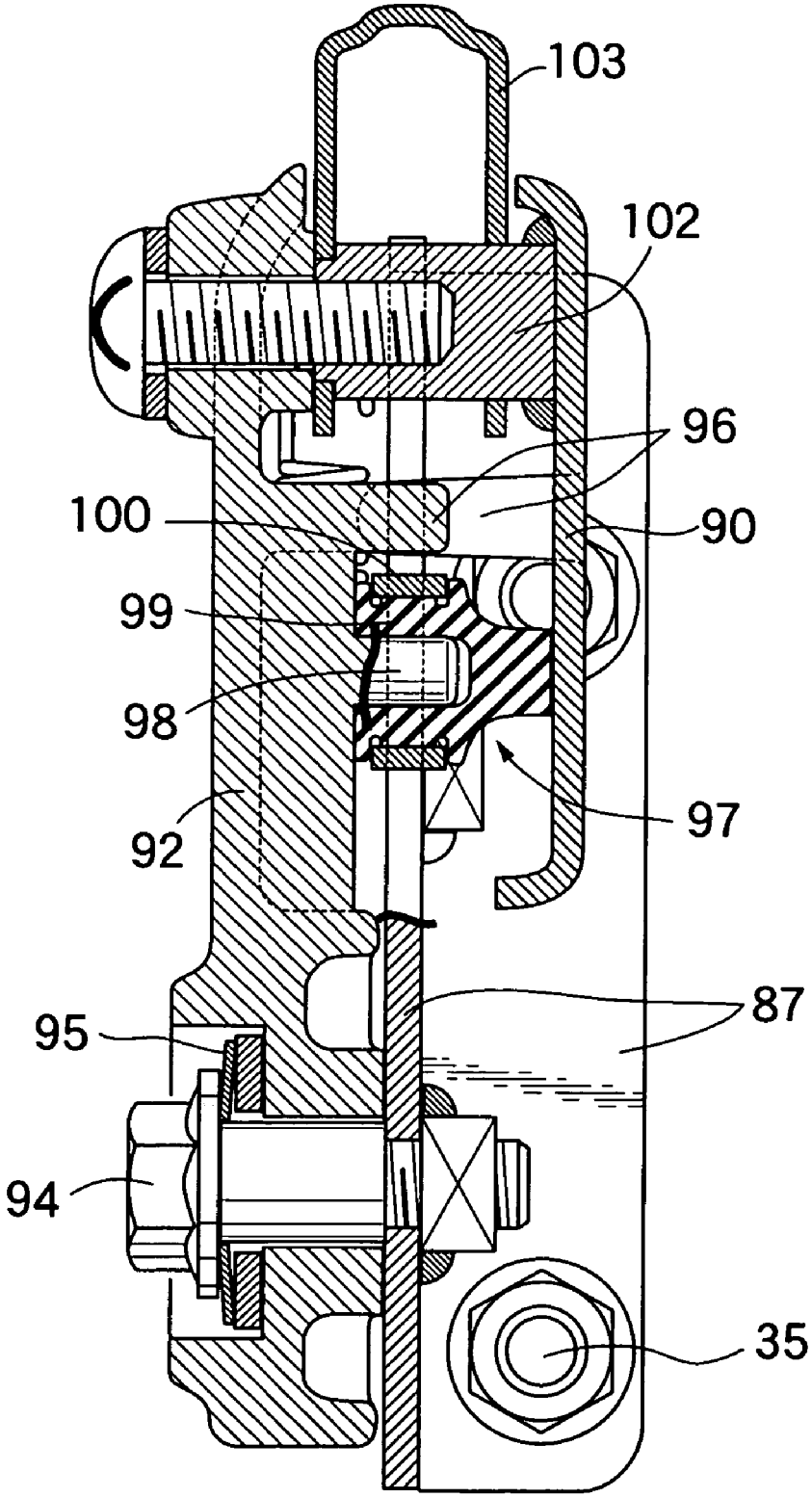
FIG. 19 is a sectional view along line 19-19 in FIG. 15.

In FIG. 13 and FIG. 14 in particular, a gutter 80 is formed on the upper cross member 8' of the frame 2 supporting a rear end part of the mounting flange 77 of the fuel tank 5, a downwardly bent edge 77*a* of the mounting flange 77 facing the gutter 80, and opposite ends of the gutter 80 communicating with outer peripheral faces of the vertical side sections of the left and right side frames 2*b* via an outflow hole 81. The outflow hole 81 is formed as a cutout in a part of the cross member 8' where it is welded to the left and right side frames 2*b*. Furthermore, formed on an upper face of the fuel tank 5 is an inclined face 5*b* that slopes down toward the gutter 80 and extends to the mounting flange 77.

When filling the fuel tank 5 with fuel, even if fuel overflowing onto the upper face of the fuel tank 5 via the fuel filler hole flows rearward, the fuel flows down the inclined face 5*b*, reaches the mounting flange 77, is guided by the downwardly bent edge 77*a* of the flange 77, reliably flows into the gutter 80, flows along the gutter 80, flows down from either one of the left and right outflow holes 81 along the outer peripheral face of the vertical side section of the corresponding one of the left and right side frames 2*b*, and drops outside the machine.

Therefore, as in the illustrated example, even when the engine 3, the generator 4, or auxiliary equipment therefor, such as the exhaust box 68, is disposed beneath the gutter 80, since the overflowing fuel will not contaminate it, the degree of freedom in the layout can be increased outstandingly.

Furthermore, since the gutter 80 is formed by utilizing the cross member 8', which is a reinforcing member of the frame 2, the structure can be simplified and, moreover, since the outflow hole 81 is formed as a cutout at opposite ends of the cross member 8', any degradation in the strength of the frame 2 can be avoided.

The duct member 31, the exhaust box 68, and the fuel tank 5 are disposed within the open type frame 2.

When the engine 3 is running, electricity is generated by driving the generator 4 by means of the rotating crankshaft 17, and the output is controlled by the inverter 55 and the control unit 53 and then taken out via a receptacle on the operation panel 53*a*.

Furthermore, the cooling fan 26, which is pivoted by the crankshaft 17, takes outside air as cooling air into the intake box 34 through the first and second intake louvers 38*a* and 38*b*, and makes it flow within the duct member 31 from the upstream end to the downstream end and through the exhaust box 68, and discharges it to the outside via the exhaust louver 73. Due to such a flow of cooling air, the control unit 53 and the inverter 55 are cooled within the intake box 34, the engine 3 and the generator 4 are cooled within the duct member 31, and the exhaust muffler 74 is cooled within the exhaust box 68.

In particular, since the upstream end part of the duct member 31, that is, the starter cover 31*a* having the vents 116*a* and 116*b*, is disposed in proximity to the back face of the inverter 55 within the intake box 34, air around the inverter 55 is taken into the duct member 31 effectively, and the inverter 55, which easily attains a relatively high temperature, can be cooled effectively.

Furthermore, exhaust gas discharged from the outlet pipe 74*a* of the exhaust muffler 74 is mixed with the cooling air within the exhaust box 68, thus lowering the exhaust temperature, and at the same time the exhaust noise can be reduced effectively.

Moreover, the cooling fan 26, which has a large diameter corresponding to the inner diameter of the duct member 31, can be simply mounted by utilizing the large outer end face of the outer rotor 23, which is cantilever-supported on the crankshaft 17, and the effect of cooling the engine 3 and the generator 4 can be enhanced.

While the engine 3 and the generator 4 are running, the operating noise generated by these and the cooling fan 26 is blocked by the duct member 31. That is, the duct member 31 plays a role as a soundproofing wall for the engine 3, the generator 4, and the cooling fan 26. Furthermore, even if the operating noise is transmitted from the upstream end and the downstream end of the duct member 31 to the intake box 34 and the exhaust box 68, by virtue of the expansion muffler effect of the intake box 34 and the exhaust box 68 the operating noise can be muffled effectively, and it is possible to prevent as much as possible the operating noise from leaking outside. In particular, with regard to the intake box 34, since the control unit 53 and the inverter 55 are disposed between the first connection opening 39 and the first intake louver 38*a*, the control unit 53 and the inverter 55 become soundproofing partitions between the first connection opening 39 and the first intake louver 38*a*, thus preventing the noise from leaking outside and thereby enhancing the muffling effect of the intake box 34. In this way, the quietness of the engine-driven generator 1 can be ensured.

Moreover, the fuel tank 5 covers the whole length of the upper face of the duct member 31, thus forming, in cooperation with the duct member 31, a double soundproofing wall for the engine 3 and the generator 4, and it is therefore possible to prevent effectively the operating noise of the engine 3 and the generator 4 from leaking upward, thus further enhancing the quietness of the engine-driven generator 1 by a simple structure.

Moreover, since the relatively large fuel tank 5 is mounted in the upper part of the left and right side frames 2*b* as described above, it is easy to mount and demount the fuel tank 5, and since it is detachable relative to the frame 2 in the same manner as the intake box 34, demounting the fuel tank 5 and the intake box 34 makes the upper face and the front face of the frame 2 open and enables the engine 3 and the generator 4 to be easily detached, thus enhancing the ease of maintenance.

Furthermore, during an intake stroke of the engine 3, since air within the intake box 34 is taken into the engine 3 via the air cleaner 45 and the carburetor 44, intake noise of the engine 3 can also be muffled effectively by the intake box 34. In particular, the battery 61 within the intake box 34 becomes a soundproofing partition between the second connection opening 40 and the first intake louver 38*a*, thus preventing the intake noise from leaking outside and thereby further enhancing the muffling effect of the intake box 34.

In this way, the operating noise of the engine 3, the generator 4, and the cooling fan 26, etc. can be reduced simply and reliably by the duct member 31 covering the engine 3 and the generator 4, and by the intake and exhaust boxes 34 and 68 connected to the upstream and downstream ends of the duct member 31 and, moreover, since the duct member 31 and the intake and exhaust boxes 34 and 68 are disposed within the open type frame 2, compared with a conventional arrangement in which an entire engine-driven generator is covered by a soundproofing wall, the engine-driven generator 1 can be made compact and lightweight. Moreover, since the carburetor 44 and the air cleaner 45 are disposed outside the duct member 31, maintenance operations thereof can be carried out easily and quickly.

Vibration occurring when such an engine 3 is running is absorbed by elastic deformation of the elastic members 11 disposed between the engine 3 and the frame 2, thus preventing the vibration from being transmitted to the frame 2 or greatly reducing it.

Since the duct member 31 and the air cleaner 45 are fixed to the engine 3, they vibrate together with the engine 3, but since the intake box 34 is fixed to the frame 2, when the engine 3 and the generator 4 are running, a relative displacement occurs between the duct member 31 and air cleaner 45 and the intake box 34 due to the vibration of the engine 3. However, since the first and second connection openings 39 and 40 of the intake box 34 are connected to the duct member 31 and the air cleaner 45 via the highly flexible first and second seals 41 and 42, the relative displacement, accompanying the vibration, between the duct member 31 and air cleaner 45 and the intake box 34 is allowed by virtue of flexure of the first and second seals 41 and 42, and it is therefore possible for cooling air to efficiently flow from the intake box 34 to the duct member 31 without leaking.

As shown in FIG. 3 and FIG. 9, a pair of left and right wheels 83 are axially supported on the base frame 2*a* of the frame 2 on the rear side, that is, on the exhaust box 68 side, and a pair of left and right grounding legs 84 are fixedly provided on the base frame 2*a* of the frame 2 on the front side, that is, the intake box 34 side.

In FIG. 1 and FIG. 15 to FIG. 19, a pair of left and right handle brackets 87 are secured via bolts 35 to upper brackets 12 at the front end of the frame 2 together with the end plate 37 of the intake box 34; these handle brackets 87 project outside through a pair of left and right slits 76 (see FIG. 8) provided in the box main body 36 of the intake box 34, and a moving handle 86 is attached to these projecting parts, the moving handle 86 being used when the engine-driven generator 1 is moved. This moving handle 86 is formed from a pair of left and right handle bars 88, a cross member 89 providing a connection between middle parts of these handle bars 88, an L-shaped base plate 92 joined by bolts to each of the handle bars 88 and a connecting plate 90 welded to the base of the handle bars 88, and a rubber handle grip 93 fitted onto the extremity of the handle bars 88. The left and right base plates 92 are connected to the left and right handle brackets 87 via horizontal pivot bolts 94, and the moving handle 86 can pivot between a working position A at which the two handle bars 88 are horizontal and a storage position B at which the handle grips 93 are directed vertically downward. A dish spring 95 is disposed between a head part of the pivot bolt 94 and the base plate 92, the dish spring 95 imparting an appropriate pivoting resistance to the moving handle 86.

The working position A of the moving handle 86 is defined by a stopper 96 formed on the connecting plate 90 and the base plate 92 abutting against an extremity face of the handle bracket 87, and the storage position B is defined by the handle grip 93 abutting against a front side section of the base frame 2*a* of the frame 2 protruding forward of the intake box 34.

A damper 97 is provided on the base plate 92, the damper 97 operating immediately before the stopper 96 abuts against the handle bracket 87 when the moving handle 86 is pivoted from the storage position B to the working position A. That is, the damper 97 is formed from a support shaft 98 projectingly provided integrally with an inner wall of the base plate 92, a cushion member 99 made of rubber fitted around the outer periphery of the support shaft 98, and a bush 100 fitted around the outer periphery of the cushion member 99, and the pivoting impact of the moving handle 86 is absorbed by elastic deformation of the cushion member 99 as a result of the bush 100 abutting against the handle bracket 87 immediately before the stopper 96 abuts against the tip face of the bracket 87.

Furthermore, a lock mechanism 101 for locking the moving handle 86 at the working position A is provided on the moving handle 86 and the handle bracket 87. This lock mechanism 101 is provided with operating levers 103 that are supported by pivot shafts 102 fixedly provided between the left and right connecting plates 90 and the base plates 92 and can pivot between a locked position L and an unlocked position U. A lock pin 105 and a lock groove 106 are provided on each of the operating levers 103 and an upper edge part of the handle bracket 87 respectively, and the lock pin 105 engages with and disengages from the lock groove 106 accompanying pivoting of the operating lever 103 between the locked position L and the unlocked position U when the moving handle 86 is at the working position A. A lock spring 107 is provided in a compressed state between the operating lever 103 and the base plate 92, the lock spring 107 urging the operating lever 103 in the locked position L direction. Furthermore, an arc face 87*a* is formed on the handle bracket 87 from the tip face to the upper edge part, the arc face 87*a* guiding the lock pin 105 so that it engages with the lock groove 106.

When the moving handle 86 is pivoted around the pivot bolt 94 from the storage position B to the working position A and the lock pin 105 arrives at the lock groove 106 while being guided by the arc face 87*a*, the operating lever 103 is pivoted to the locked position L by virtue of the urging force of the lock spring 107 and the lock pin 105 engages with the lock groove 106. In this way, the moving handle 86 is locked at the horizontal working position A.

In a state in which the left and right grips 93 of the moving handle 86 are held and pulled upward so as to lift the grounding legs 84 off the ground, by pushing or pulling the moving handle 86 the engine-driven generator 1 can be moved lightly by virtue of rotation of the wheels 83.

Even if a hand is detached from the moving handle 86 during use thereof, since the handle 86 remains locked by the lock mechanism 101, it is possible to prevent the handle 86 from pivoting to the storage position B due to its own weight, thus achieving good operability for the handle 86.

Furthermore, when the moving handle 86 is pivoted to the working position A, since the cushion member 99 of the damper 97 abuts against the handle bracket 87 via the bush 100 and elastically deforms immediately before the stopper 96 abuts against the handle bracket 87, a pivoting impact of the moving handle 86 can be absorbed and, moreover, since the elastic deformation of the cushion member 99 is maintained after the handle 86 is locked at the working position A by the lock mechanism 101, its resilient force can prevent the lock mechanism 101 from rattling. Furthermore, since direct contact of the cushion member 99 with the handle bracket 87 is avoided by the bush 100 covering the outer periphery of the cushion member 99, the durability thereof can be enhanced.

After movement thereof, by pivoting the operating lever 103 to the unlocked position U against the urging force of the lock spring 107 so as to disengage the lock pin 105 from the lock groove 106, the moving handle 86 can freely pivot around the pivot bolt 94. Therefore, the handle 86 can be pivoted to the storage position B, in which it is in a vertical attitude.

In this process, since the left and right handle grips 93 of the moving handle 86 abut against the base frame 2*a* of the frame 2, the left and right handle bars 88 and the cross member 89 are disposed on the front face of the intake box 34, thus playing a role as a strong bumper for protecting the intake box 34, as well as the control unit 53, the inverter 55, and the battery 61, from contact with another object.

Furthermore, in a state in which the moving handle 86 is folded at the storage position B as described above, work using the engine-driven generator 1 can easily be carried out without interfering with the moving handle 86 and, furthermore, when the engine-driven generator 1 is stored in a warehouse, etc., a relatively small space is sufficient for storage.

Moreover, since the handle 86 functions as a bumper, the intake box 34 can be protected effectively by means of the moving handle 86 pivoted to the storage position and the base frame 2*a* of the frame 2 without providing a special guard frame on the intake box 34, and it is therefore possible to make the box main body 36 of the large intake box 34 housing the control unit 53, the inverter 55, and the battery 61 of a synthetic resin, thus reducing the weight thereof.

The present invention is not limited to the above-mentioned embodiment, and can be modified in a variety of ways as long as it does not depart from the spirit and scope thereof.

For example, the air cleaner 45 may also be fixedly supported on the frame 2 in the same manner as for the intake box 34, relative displacement between the carburetor 44 and the air cleaner 45 accompanying vibration of the engine 3 being absorbed by flexure of the elastic communicating tube 46 providing communication between the carburetor 44 and the air cleaner 45, and in this case the air inlet pipe 47*a* of the air cleaner 45 can be connected integrally to the intake box 34.

Furthermore, the outlet pipe of the exhaust muffler 74 may be opened to the outside by making it run through an outer wall of the exhaust box 68 as shown by the reference numeral 74*a*' in FIG. 9. In this case, only cooling air is discharged from the exhaust louver 73 of the exhaust box 68.

The invention claimed is:

1. An engine-driven generator formed by supporting on a frame an engine and a generator driven by the engine, wherein the frame is formed as an open periphery framework type frame, within the frame a duct member is disposed around an outer periphery of the engine and the generator, the duct member defining a series of cooling air passages between itself, the engine, and the generator, a cooling fan is provided in the cooling air passage, the cooling fan being driven by the engine to generate cooling air flowing from an upstream end side to a downstream end side of the duct member in the cooling air passage, an intake box having an intake opening at an outer end thereof and housing an electrical component is connected to the upstream end of the duct member, and an exhaust box having an exhaust opening at an outer end thereof and housing an exhaust muffler of the engine, said exhaust box being connected to the other end of the duct member, wherein the duct member and the intake box are connected by a seal that allows relative displacement therebetween.

2. The engine-driven generator according to claim 1, wherein the exhaust box has a cross-sectional area configured to define a muffler expansion chamber.

3. The engine-driven generator according to claim 2, wherein a fuel tank is disposed above the duct member, the fuel tank covering an upper face of the duct member throughout a length of the duct member.

4. The engine-driven generator according to either claim 1 or 2, wherein an assembly of the engine and the generator is resiliently supported on the frame, the duct member is fixedly supported on the assembly, and the intake box is fixedly supported on the frame.

5. The engine-driven generator according to any one of claims 1 to 3, wherein the generator is formed from a magnet generator that includes an outer rotor cantilever-supported by a crankshaft of the engine, and the cooling fan is mounted on an outer end face of the outer rotor.

6. The engine-driven generator according to claim 1, wherein an intake control system of the engine and an air cleaner for cleaning intake air therefor are disposed outside the duct member, and an air inlet of the air cleaner is connected to the intake box.

7. The engine-driven generator according to claim 1, wherein the upstream end of the duct member is connected to the intake box having the intake opening, an air cleaner of the engine is disposed outside the duct member, and an air inlet pipe of the air cleaner is connected to the intake box.

8. The engine-driven generator according to claim 7, wherein an assembly of the engine and the generator is resiliently supported on the frame, the duct member and the air cleaner are fixedly supported on the assembly, the intake box is fixedly supported on the frame, and the intake box and the air inlet pipe of the air cleaner are connected by another seal that allows relative displacement therebetween.

9. The engine-driven generator according to claim 7, wherein an assembly of the engine and the generator is resiliently supported on the frame, the duct member is fixedly supported on the assembly, the air cleaner and the intake box are fixedly supported on the frame, and the engine and the air cleaner are connected via a flexible communicating tube that allows relative displacement therebetween.

10. The engine-driven generator according to any one of claims 7 to 9, wherein a cylinder part of the engine is inclined toward one side of a crankcase, and at least part of the air cleaner extending along an axial direction of a crankshaft of the engine is disposed beneath a cylinder part.

11. The engine-driven generator according to any one of claims 7 to 9, wherein the electrical component is disposed within the intake box between the intake opening and a section where the intake box and the duct member are connected.

12. The engine-driven generator according to any one of claims 7 to 9, wherein the downstream end of the duct member is connected to the exhaust box having the exhaust opening, and an exhaust muffler of the engine is disposed in the exhaust box.

13. The engine-driven generator according to claim 1, wherein the engine is resiliently supported on the frame, the duct member is fixedly provided on the engine and the generator within the frame, the intake box being fixedly mounted on the frame, and wherein the seal connects the intake box and an upstream part of the duct member.

14. The engine-driven generator according to claim 13, wherein an upstream end part of the duct member is projectingly disposed within the intake box and in proximity to at least part of the electrical component.

15. The engine-driven generator according to either claim 13 or 14, wherein a recoil starter of the engine is disposed so that a rope pulley of the recoil starter projects within the intake box, a starter rope extending from the rope pulley is taken outward from one side wall of the intake box, and an operating knob is connected to the outer end of the starter rope.

16. The engine-driven generator according to either claim 13 or 14, wherein an air cleaner of the engine is disposed outside the duct member, and an air inlet of the air cleaner and the intake box are connected to each other by another seal that allows relative displacement therebetween.

17. The engine-driven generator according to claim 1, wherein the intake box is arranged to have the intake opening positioned at one of opposite side portions of the frame and the exhaust box and is arranged to have the exhaust opening positioned at the other of the opposite side portions of the frame, a crankshaft of the engine is set to have an axis directed toward the opposite side portions of the frame, a cover is provided between the intake box and the duct member and a member is provided for separating the exhaust box and an inside of the duct member, and the intake box, the duct member and the exhaust box are arranged in alignment along the axis of the crankshaft.

18. An engine-driven generator formed by supporting on a frame an engine and a generator driven by the engine, wherein the frame is formed as an open periphery framework type frame, within the frame a duct member is disposed around an outer periphery of the engine and the generator, the duct member defining a series of cooling air passages between itself, the engine, and the generator, a cooling fan is provided in the cooling air passage, the cooling fan being driven by the engine to generate cooling air flowing from an upstream end side to a downstream end side of the duct member in the cooling air passage, an intake box having an intake opening at an outer end thereof and housing an electrical component is connected to the upstream end of the duct member, and an exhaust box having an exhaust opening at an outer end thereof and housing an exhaust muffler of the engine which is connected to the other end of the duct member, wherein the upstream end of the duct member is connected to the intake box having the intake opening, an air cleaner of the engine is disposed outside the duct member, and an air inlet pipe of the air cleaner is connected to the intake box.

19. An engine-driven generator formed by supporting on a frame an engine and a generator driven by the engine, wherein the frame is formed as an open periphery framework type frame, within the frame a duct member is disposed around an outer periphery of the engine and the generator, the duct member defining a series of cooling air passages between itself, the engine, and the generator, a cooling fan is provided in the cooling air passage, the cooling fan being driven by the engine to generate cooling air flowing from an upstream end side to a downstream end side of the duct member in the cooling air passage, an intake box having an intake opening at an outer end thereof and housing an electrical component is connected to the upstream end of the duct member, and an exhaust box having an exhaust opening at an outer end thereof and housing an exhaust muffler of the engine which is connected to the other end of the duct member, wherein the engine is resiliently supported on the frame, the duct member is fixedly provided on the engine and the generator within the frame, the intake box being fixedly mounted on the frame, and wherein a seal connects the intake box and an upstream part of the duct member.

* * * * *